US011657754B2

(12) United States Patent
Momose et al.

(10) Patent No.: US 11,657,754 B2
(45) Date of Patent: May 23, 2023

(54) ELECTRO-OPTICAL DEVICE AND ELECTRONIC APPARATUS

(71) Applicant: SEIKO EPSON CORPORATION, Tokyo (JP)

(72) Inventors: Yoichi Momose, Matsumoto (JP); Mitsutoshi Miyasaka, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/556,432

(22) Filed: Dec. 20, 2021

(65) Prior Publication Data

US 2022/0199003 A1 Jun. 23, 2022

(30) Foreign Application Priority Data

Dec. 22, 2020 (JP) ..... JP2020-212119

(51) Int. Cl.
*G09G 3/20* (2006.01)
*G09G 3/32* (2016.01)
*G09G 3/3233* (2016.01)

(52) U.S. Cl.
CPC ..... *G09G 3/32* (2013.01); *G09G 3/2022* (2013.01); *G09G 3/2033* (2013.01); (Continued)

(58) Field of Classification Search
CPC ..... G09G 3/2022; G09G 3/2033; G09G 3/32; G09G 3/3233; G09G 2300/0842; (Continued)

(56) References Cited

U.S. PATENT DOCUMENTS 8,334,827 B2 12/2012 Seo et al.
9,280,934 B2 * 3/2016 Kawabe ..... G09G 3/2081
(Continued)

FOREIGN PATENT DOCUMENTS

JP 2004-086153 A 3/2004
JP 2005-316382 A 11/2005
(Continued)

OTHER PUBLICATIONS

Sep. 21, 2022 Notice of Allowance Issued In U.S. Appl. No. 17/559,083.

*Primary Examiner* — Gene W Lee
(74) *Attorney, Agent, or Firm* — Oliff PLC

(57) ABSTRACT

The electro-optical device includes a plurality of digital scanning lines, a plurality of analog scanning lines, a digital signal line, an analog signal line, and a plurality of pixel circuits. Each of the pixel circuits includes a light emitting element, a digital driving circuit, and an analog driving circuit. The digital driving circuit performs digital driving in which a drive current is supplied to the light emitting element in a period of a length corresponding to a grayscale value. The analog driving circuit performs analog current setting in which a current value of the drive current is set based on an analog data voltage. In a period in which the pixel circuit connected to an s-th digital scanning line and an s-th analog scanning line performs the analog current setting, the pixel circuit connected to a t-th digital scanning line and a t-th analog scanning line performs the digital driving.

20 Claims, 18 Drawing Sheets

(52) U.S. Cl.
CPC ... *G09G 3/3233* (2013.01); *G09G 2300/0842* (2013.01); *G09G 2300/0852* (2013.01); *G09G 2300/0857* (2013.01); *G09G 2310/08* (2013.01); *G09G 2320/0247* (2013.01); *G09G 2360/144* (2013.01)

(58) Field of Classification Search
CPC ... G09G 2300/0852; G09G 2300/0857; G09G 2310/08; G09G 2320/0247; G09G 2360/144
See application file for complete search history.

(56) References Cited

U.S. PATENT DOCUMENTS

| | | | | |
|---|---|---|---|---|
| 9,653,015 | B2 * | 5/2017 | Hu | G09G 3/2074 |
| 10,147,349 | B2 * | 12/2018 | Hu | G09G 3/2074 |
| 10,147,350 | B2 * | 12/2018 | Hu | G09G 3/3648 |
| 10,311,773 | B2 * | 6/2019 | Hu | G09G 3/3607 |
| 10,847,077 | B2 * | 11/2020 | Sakariya | G09G 3/2014 |
| 11,138,918 | B2 * | 10/2021 | Sakariya | G09G 3/32 |
| 2004/0013427 | A1 | 1/2004 | Ito | |
| 2005/0243077 | A1 | 11/2005 | Chung et al. | |
| 2006/0244697 | A1 | 11/2006 | Lee et al. | |
| 2009/0102749 | A1 * | 4/2009 | Kawabe | G09G 3/3233 345/45 |
| 2019/0235250 | A1 | 8/2019 | Miyasaka et al. | |
| 2019/0347981 | A1 | 11/2019 | Horowitz et al. | |

FOREIGN PATENT DOCUMENTS

| | | | |
|---|---|---|---|
| JP | 2008-281827 | A | 11/2008 |
| JP | 2013-104910 | A | 5/2013 |
| JP | 2019-132941 | A | 8/2019 |
| JP | 2020-064159 | A | 4/2020 |
| JP | 2020-95107 | A | 6/2020 |

* cited by examiner

ELECTRO-OPTICAL DEVICE AND ELECTRONIC APPARATUS

The present application is based on, and claims priority from JP Application Serial Number 2020-212119, filed Dec. 22, 2020, the disclosure of which is hereby incorporated by reference herein in its entirety.

BACKGROUND

1. Technical Field

The present disclosure relates to an electro-optical device and an electronic apparatus.

2. Related Art

JP-A-2019-132941 and JP-A-2008-281827 disclose a technique in which, in a display device using a light emitting element in a pixel, by causing the pixel to emit light only for a time that has been weighted in accordance with each of bits of display data, grayscale display is performed as a time average. Further, in JP-A-2019-132941 and JP-A-2008-281827, a technique is disclosed in which, while a plurality of scanning lines are selected sequentially one by one in descending order, a first bit is set to a pixel electrically connected to each of the scanning lines. Subsequently, while the plurality of scanning lines are selected sequentially one by one in descending order in the same manner, a second bit is set to the pixel electrically connected to each of the scanning lines, and this is continued up to the MSB.

In a head-mounted display, a head-up display, or the like, a user may sometimes wish to adjust a display luminance to match a brightness of the environment. However, in the above-mentioned JP-A-2019-132941 and JP-A-2008-281827, since the grayscale display is performed using a length of an overall light emitting period in a single frame by causing the light-emitting element to emit light or not emit light for a time period weighted in accordance with each of the bits of the display data, a light emitting luminance at a maximum gradation is fixed. In order to adjust the display luminance to match the brightness of the environment, it is necessary to perform the display with the maximum gradation as the maximum luminance in a bright environment, and with a gradation lower than the maximum gradation as the maximum luminance in a dark environment. As a result, there is a problem in that adjustment of the display luminance in accordance with the brightness of the environment and a favorable grayscale display cannot both be achieved simultaneously.

SUMMARY

According to an aspect of the present disclosure, an electro-optical device includes a plurality of digital scanning lines, a plurality of analog scanning lines, a digital signal line, an analog signal line, and a plurality of pixel circuits. Each of the plurality of pixel circuits is electrically connected to one of the digital scanning lines of the plurality of digital scanning lines, one of the analog scanning lines of the plurality of analog scanning lines, the digital signal line, and the analog signal line. Each of the pixel circuits includes a light emitting element, a digital driving circuit configured to perform digital driving in which display data is set through the digital signal line when the digital driving circuit is selected through the digital scanning line and a drive current is supplied to the light emitting element in an on period of a length corresponding to a grayscale value of the display data, and an analog driving circuit configured to perform analog driving setting in which an analog data voltage is set through the analog signal line when the analog driving circuit is selected by the analog scanning line, and a current value of the drive current is variably set based on the analog data voltage. In a period in which an s-th pixel circuit performs an analog current setting, a t-th pixel circuit performs the digital driving, the s-th pixel circuit being, of the plurality of pixel circuits, the pixel circuit electrically connected to an s-th digital scanning line and an s-th analog scanning line (s is an integer of 1 or more), and the t-th pixel circuit being, of the plurality of pixel circuits, the pixel circuit electrically connected to a t-th digital scanning line and a t-th analog scanning line (t is an integer of 1 or more and different from s).

Further, according to another aspect of the present disclosure, an electronic apparatus includes the above electro-optical device.

DESCRIPTION OF EMBODIMENTS

An embodiment of the present disclosure will be described in detail below. Note that the embodiment described below is not intended to wrongfully limit the content of the present disclosure as set forth in the claims, and all configurations described in the embodiment are not necessarily required constituent elements.

1. As described above, with respect to display luminance adjustment in accordance with the brightness of the environment, in the case of a head-mounted display, a head-up display, or the like, there are cases where a user wishes to adjust the display luminance in accordance with the brightness of the environment. Issues relating to the display luminance adjustment are described using analog driving and digital driving as examples.

Figure 1:
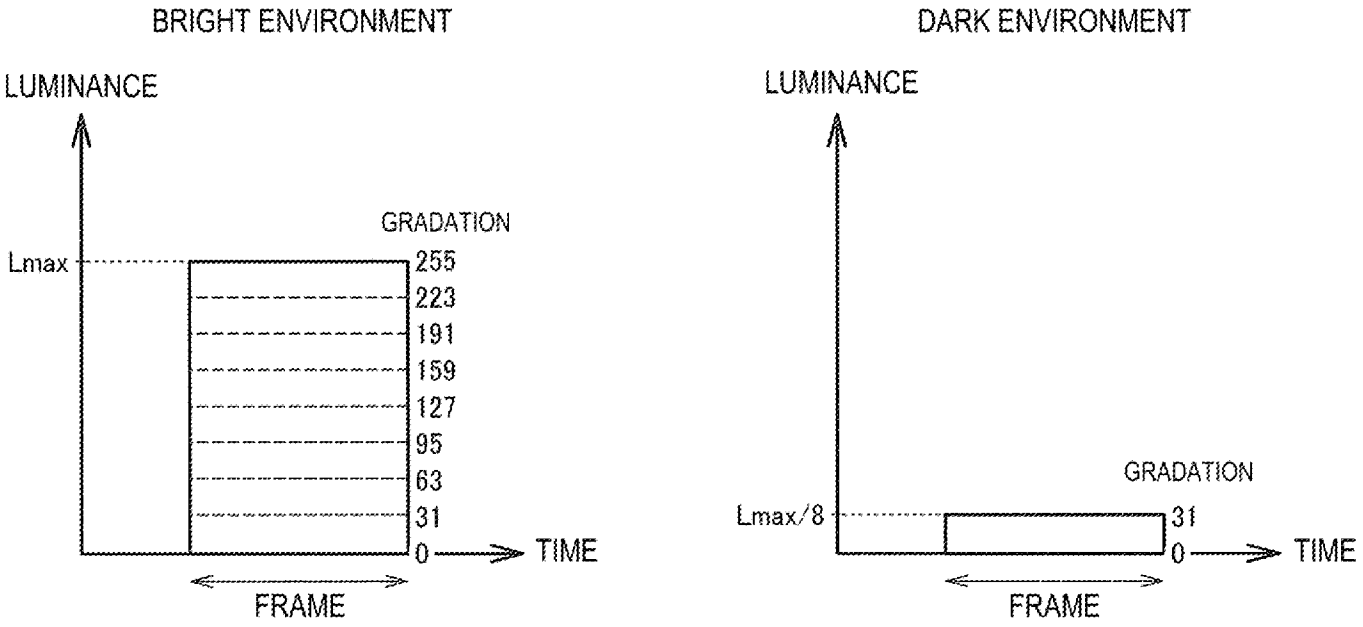
FIG. 1 is a diagram illustrating display luminance adjustment when performing display by analog driving.

FIG. 1 is a diagram illustrating display luminance adjustment when performing the display using the analog driving. In the analog driving, a pixel circuit causes a drive current corresponding to a grayscale value to flow to a light emitting element. Since the drive current is constant in one frame, the light emitting element continues to emit light at the same luminance in the one frame. Here, a range of the grayscale values is assumed to be from 0 to 255.

As illustrated in the diagram on the left side, the display is performed using all the grayscale values of 0 to 255 in a bright environment, and thus, when the grayscale value is 255, the light emitting element emits the light at a maximum luminance. This maximum luminance is denoted by Lmax. As illustrated in the diagram on the right side, it is assumed that, in a dark environment, the maximum luminance is adjusted to Lmax/8. Since the luminance Lmax/8 corresponds to the grayscale value of 31, the display is performed using the grayscale values of 0 to 31, and a favorable grayscale display cannot be maintained in the dark environment.

Note that when the maximum luminance is lowered while maintaining a number of gradations by reducing the drive current at the grayscale value 255, the drive current at the lower gradations becomes extremely small. In order to cause the light emitting element to emit the light in a stable manner, a certain amount of current is necessary, and it is thus not possible to significantly reduce the drive current while maintaining the number of gradations. In order to deal with the bright environment and the dark environment, it is conceivable, for example, that a several ten-fold to several hundred-fold display luminance difference is necessary, but in the analog driving, it is difficult to deal with the several ten-fold to several hundred-fold display luminance difference while maintaining the number of gradations.

Figure 2:
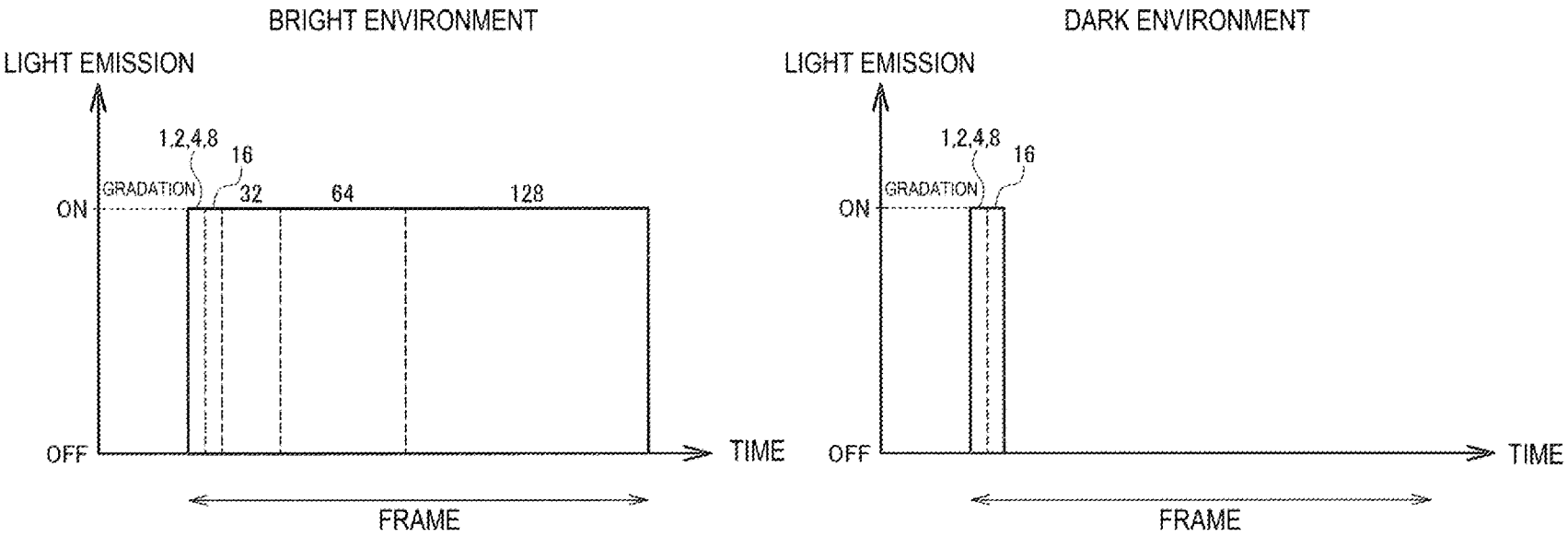
FIG. 2 is a diagram illustrating the display luminance adjustment when performing display by digital driving.

FIG. 2 is a diagram illustrating the display luminance adjustment when performing the display by digital driving. In the digital driving, the pixel circuit causes the light emitting element to emit the light in a display period of a length corresponding to the grayscale value, in one frame. Here, a range of the grayscale values is assumed to be from 0 to 255.

In FIG. 2, ON means light emission, and OFF means no light emission, and the one frame is constituted only by the two states of light emission and no light emission. A light-emitting luminance is fixed during the ON period. An interval delineated by dotted lines is a display period, and a numeral above that interval is the grayscale value corresponding to that display period. The display periods corresponding to the grayscale values of 1, 2, 4, 8, 16, 32, 64, and 128 are provided, and a length of the display period is weighted by a power of two. For example, when the grayscale value is 81=1+16+64, the light emitting element emits the light in the display period corresponding to the grayscale values 1, 16, and 64, and the light emitting element is turned off during the other display periods. Note that the display periods corresponding to the grayscale values 1, 2, 4, and 8 are illustrated in the single interval, but in reality, the display period is provided for each of the grayscale values.

As illustrated in the diagram on the left side, the display is performed using all the grayscale values of 0 to 255 in the bright environment, and thus, when the grayscale value is 255, the light emitting element emits the light for the entire display period This state is the maximum luminance in the bright environment. As illustrated in the diagram on the right side, it is assumed that, in the dark environment, the maximum luminance is adjusted to ⅛ of the maximum luminance. Since ⅛ of the maximum luminance of the bright environment corresponds to the grayscale value of 31, the display is performed using the grayscale values of 0 to 31, and the favorable grayscale display cannot be maintained in the dark environment.

As described above, there is an issue in that, in the known analog driving and digital driving, the adjustment of the display luminance in accordance with the brightness of the environment and the favorable grayscale display cannot both be achieved simultaneously.

2. First Configuration Example of Electro-optical Device and Display System

Figure 3:
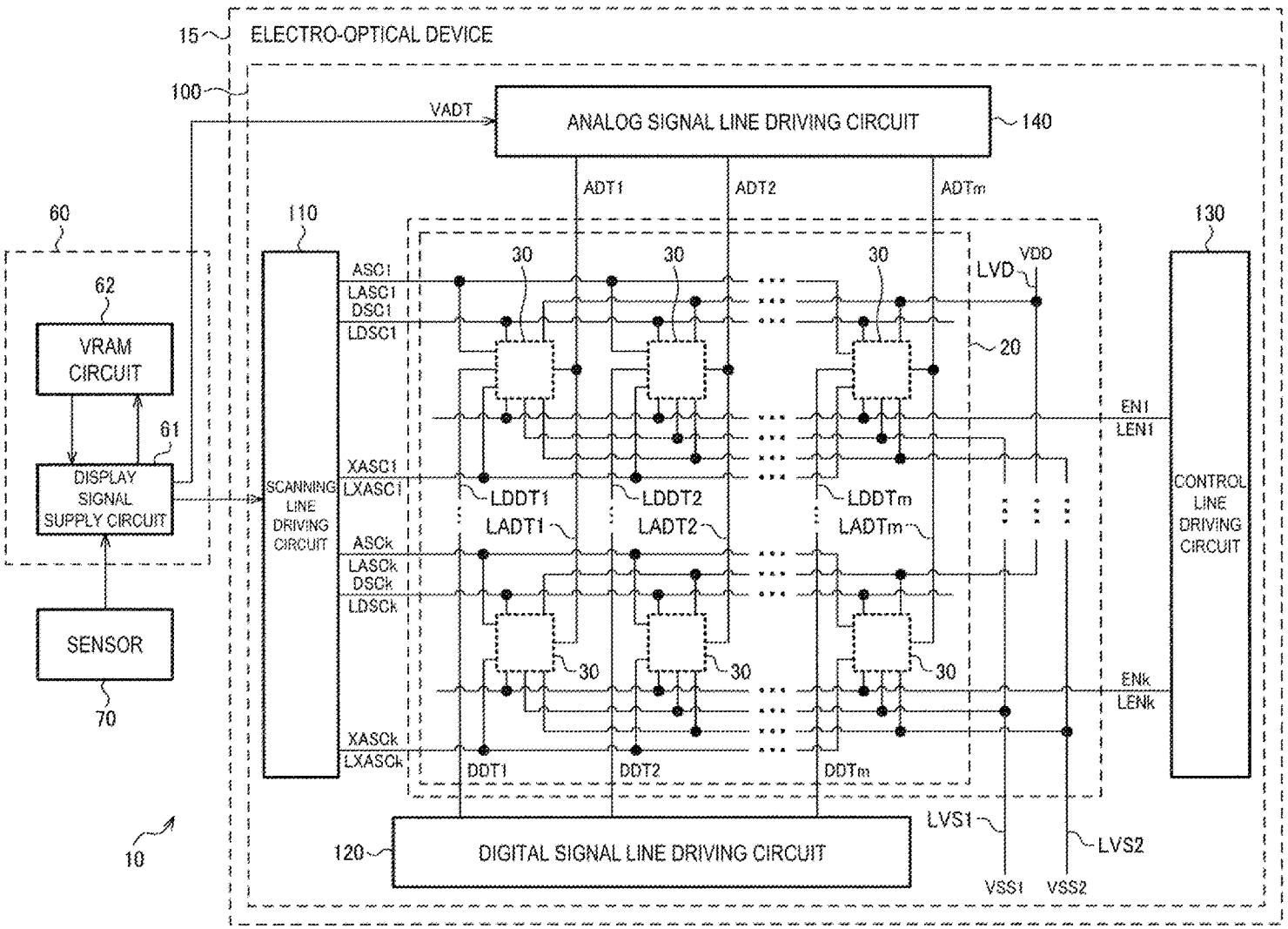
FIG. 3 is a first configuration example of an electro-optical device and a display system.

FIG. 3 is a first configuration example of an electro-optical device 15 and a display system 10 according to the embodiment. The display system 10 includes a display controller 60 and the electro-optical device 15. The electro-optical device 15 includes a circuit device 100 and a pixel array 20.

The display controller 60 outputs display data to the circuit device 100 and performs display timing control. The display controller 60 includes a display signal supply circuit 61 and a VRAM circuit 62.

The VRAM circuit 62 stores the display data to be displayed in the pixel array 20. For example, when the VRAM circuit 62 stores image data for one image, the VRAM circuit 62 stores the display data one bit at a time corresponding to each of pixels of the pixel array 20.

The display signal supply circuit 61 generates a control signal for controlling the display timing. The control signal is, for example, a vertical synchronization signal, a horizontal synchronization signal, a clock signal, and the like. The display signal supply circuit 61 reads the display data from the VRAM circuit 62 in accordance with the display timing, and outputs that display data and the control signal to the circuit device 100. Further, the display signal supply circuit 61 outputs an analog data voltage VADT to the circuit device 100 based on luminance information of the environment. A sensor 70 is a sensor that detects the luminance information of the environment, and is a photodiode or an image sensor, for example. The display signal supply circuit 61 controls the analog data voltage VADT so as to reduce a current value of the drive current as the luminance of the environment becomes lower. Note that although an example is described in which the display signal supply circuit 61 outputs the analog data voltage VADT, a voltage generation circuit or the like incorporated in an electronic apparatus in which the electro-optical device 15 is installed may output the analog data voltage VADT.

The electro-optical device 15 is, for example, an organic EL display element or a micro LED display element. The electro-optical device 15 is also referred to as an electro-optical element, a display element, an electro-optical panel, a display panel, an electro-optical device, or a display device. The electro-optical device 15 includes a semiconductor substrate (not illustrated), and the pixel array 20 and the circuit device 100 are formed on the semiconductor substrate. Note that the pixel array 20 may be formed on a glass substrate, and the circuit device 100 may be configured by an integrated circuit device.

Figure 9:
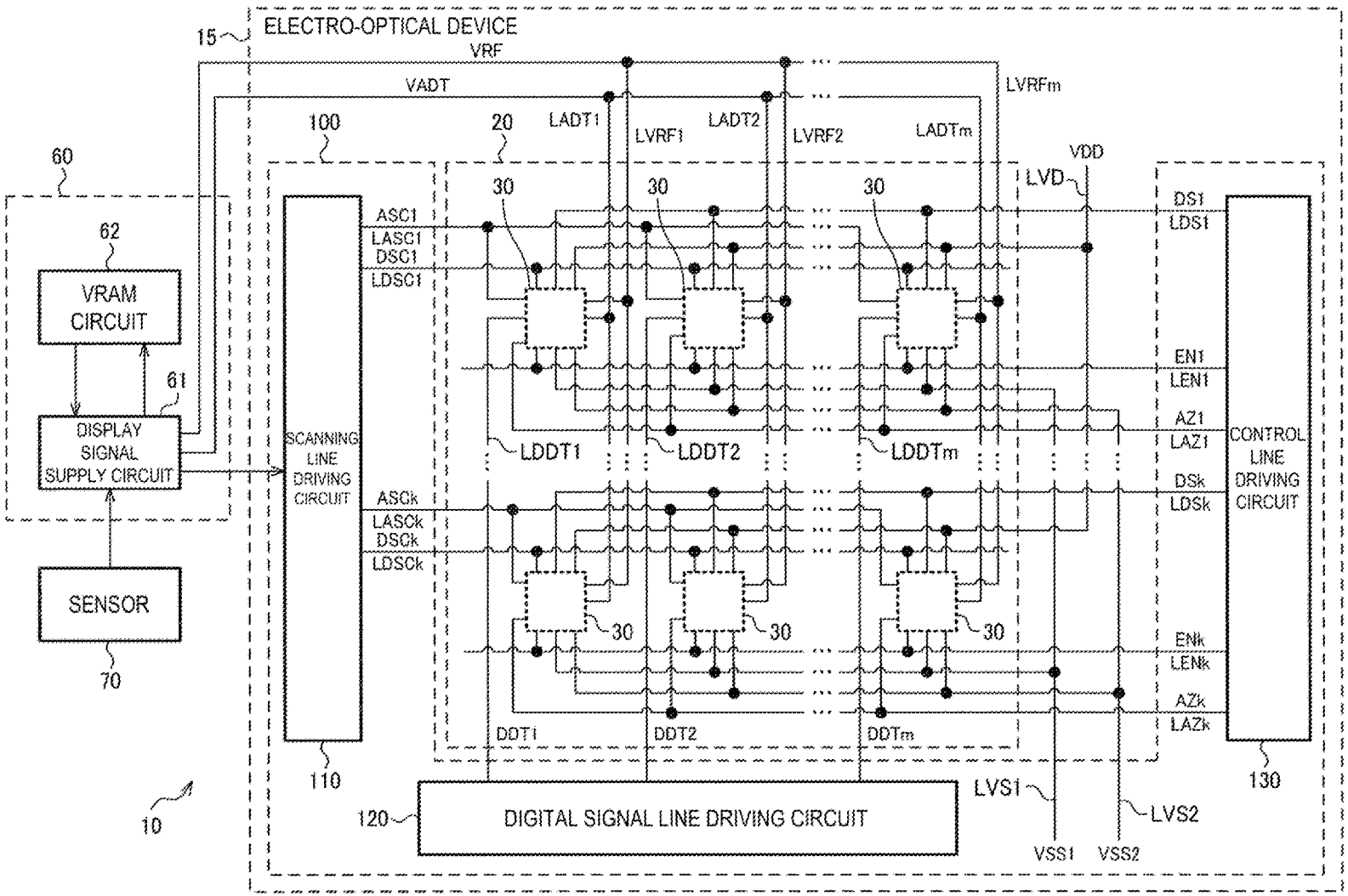
FIG. 9 is a second configuration example of the electro-optical device and the display system.

The circuit device 100 drives the pixel array 20 based on the display data and the control signal from the display controller 60, to cause the pixel array 20 to display the image. The circuit device 100 includes a scanning line driving circuit 110, a digital signal line driving circuit 120, a control line driving circuit 130, and an analog signal line driving circuit 140. Note that when a pixel circuit 30 performs threshold compensation, the analog signal line driving circuit 140 may be omitted, as illustrated in FIG. 9.

The pixel array 20 includes a plurality of the pixel circuits 30 arranged in a matrix of k rows and m columns. k and m are integers equal to or greater than 2 Further, the pixel array 20 also includes analog scanning lines LASC1 to LASCk, analog inversion scanning lines LXASC1 to LXASCk, digital scanning lines LDSC1 to LDSCk, enable signal lines LEN1 to LENk, analog signal lines LADT1 to LADTm, digital signal lines LDDT1 to LDDTm, a power source line LVD, and ground lines LVS1 and LVS2.

The analog scanning line LASC1, the analog inversion scanning line LXASC1, the digital scanning line LDSC1, and the enable signal line LEN1 are electrically connected to the pixel circuits 30 in the first row. The scanning line driving circuit 110 outputs an analog selection signal ASC1 to the analog scanning line LASC1, outputs an analog inversion selection signal XASC1, which is a logical inversion signal of the analog selection signal ASC1, to the analog inversion scanning line LXASC1, and outputs a digital selection signal DSC1 to the digital scanning line LDSC1. The control line driving circuit 130 outputs an enable signal EN1 to the enable signal line LEN1. Similarly, the analog scanning lines LASC2 to LASCk, the analog inversion scanning lines LXASC2 to LXASCk, the digital scanning lines LDSC2 to LDSCk, and the enable signal lines LEN2 to LENk are electrically connected to the pixel circuits 30 in the second to k-th rows. The scanning line driving circuit 110 outputs analog selection signals ASC2 to ASCk to the analog scanning lines LASC2 to LASCk, outputs analog inversion selection signals XASC2 to XASCk, which are logical inversion signals of the analog selection signals ASC2 to ASCk, to the analog inversion scanning lines LXASC2 to LXASCk, and outputs digital selection signals DSC2 to DSCk to the digital scanning lines LDSC2 to LDSCk. The control line driving circuit 130 outputs enable signals EN2 to ENk to the enable signal lines LEN2 to LENk.

The analog signal line LADT1 and the digital signal line LDDT1 are electrically connected to the pixel circuits 30 in the first column. The analog signal line driving circuit 140 generates a threshold-compensated analog data voltage ADT1 from the analog data voltage VADT, and outputs the analog data voltage ADT1 to the analog signal line LADT1. The digital signal line driving circuit 120 outputs a digital data signal DDT1 to the digital signal line LDDT1. The digital data signal DDT1 is a signal of any one of n bits of the display data. Similarly, the analog signal lines LADT2 to LADTm and the digital signal lines LDDT2 to LDDTm are electrically connected to the pixel circuits 30 in the second to m-th columns. The analog signal line driving circuit 140 generates threshold-compensated analog data voltages ADT2 to ADTm from the analog data voltage VADT, and outputs the analog data voltages ADT2 to ADTm to the analog signal lines LADT2 to LADTm. The digital signal line driving circuit 120 outputs digital data signals DDT2 to DTm to the digital signal lines LDDT2 to LDDTm.

Here, the threshold compensation is to compensate for variations in the drive current by compensating for threshold variation in a transistor that generates the drive current of the light emitting device. The analog signal line driving circuit 140 stores k×m compensation values corresponding to the k rows and m columns of the pixel circuits 30, and generates the analog data voltages ADT1 to ADTm by compensating for the analog data voltage VADT using the m compensation values corresponding to the m pixel circuits 30 electrically connected to the selected analog scanning lines.

The power source line LVD and the ground lines LVS1 and LVS2 are electrically connected to all the pixel circuits 30. A power supply voltage VDD is supplied to the power source line LVD from a power supply circuit (not illustrated). A first ground voltage VSS1 is supplied to the first ground line LVS1 from the power supply circuit (not illustrated), and a second ground voltage VSS2 is supplied to the second ground line LVS2 from the power supply circuit (not illustrated). Note that the ground lines LVS1 and LVS2 may be a single common ground line.

Figure 4:
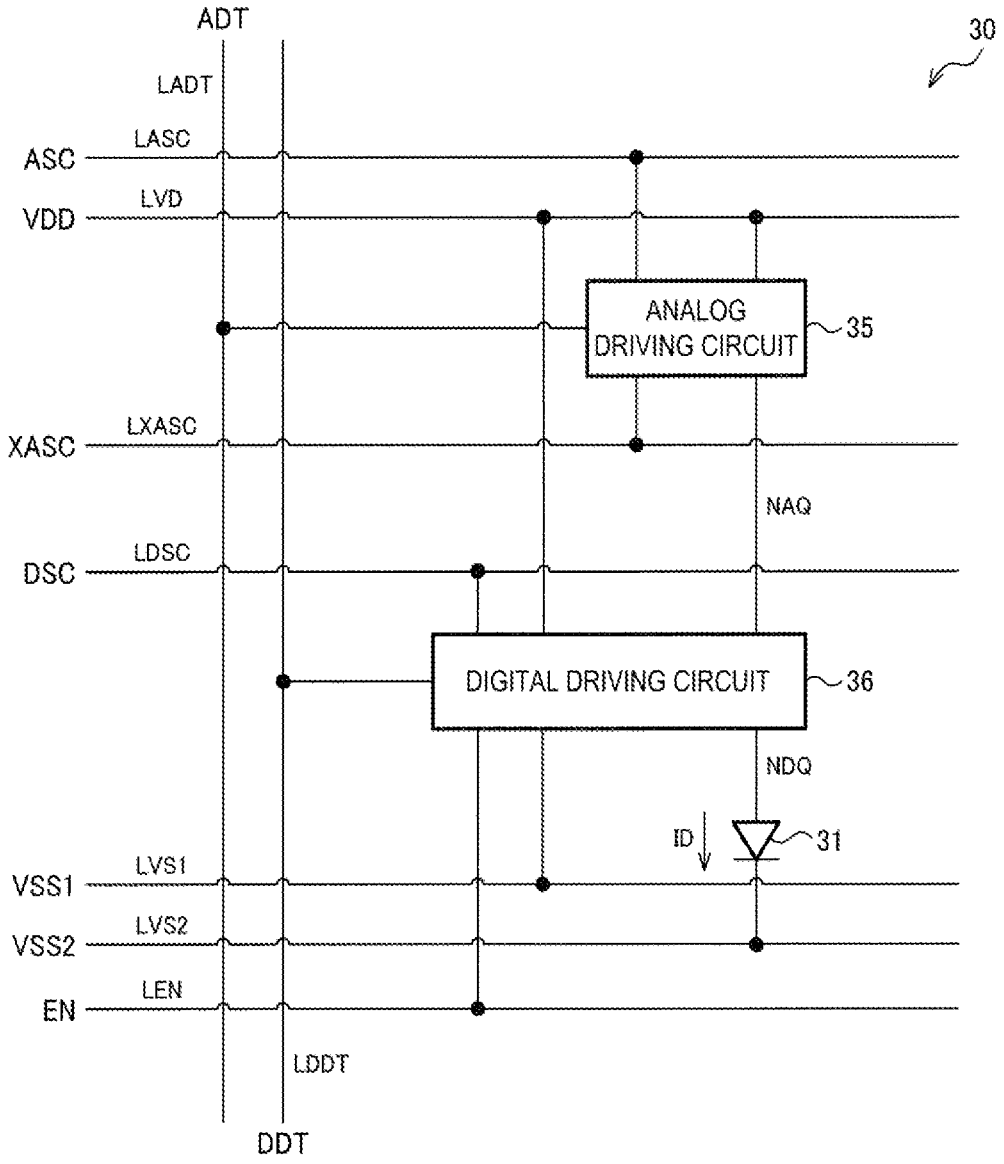
FIG. 4 is a configuration example of a pixel circuit.

FIG. 4 is a configuration example of the pixel circuit 30. The pixel circuit 30 includes an analog driving circuit 35, a digital driving circuit 36, and a light emitting element 31. Note that in FIG. 4, in relation to ASC1 to ASCk, DSC1 to DSCk, ADT1 to ADTm, DDT1 to DDTm, and the like, 1 to k and 1 to m are omitted. For example, ASC refers any one of ASC1 to ASCk.

Hereinafter, an example is described in which the analog driving circuit 35, the digital driving circuit 36, and the light emitting element 31 are electrically connected side by side in that order, from the power source to the ground. However, the light emitting element 31, the digital driving circuit 36, and the analog driving circuit 35 may be electrically connected side by side in that order, from the power source to the ground.

The analog driving circuit 35 captures the analog data voltage ADT when the analog scanning line LASC and the analog inversion scanning line LXASC are selected and holds that analog data voltage ADT. The analog driving circuit 35 causes the drive current of a current value specified by the held analog data voltage ADT to flow from the power source line LVD to a node NAQ. In the following description, an operation of setting this drive current is referred to as analog current setting.

The digital driving circuit 36 captures the digital data signal DDT when the digital scanning line LDSC is selected and stores that digital data signal DDT. The digital driving circuit 36 causes the drive current to flow from the node NAQ to a node NDQ when the digital data signal DDT is active, and blocks the drive current when the digital data signal DDT is inactive. Note that in the following description, it is assumed that an active bit is "0" or low level, and an inactive bit is "1" or high level.

The light emitting element 31 is, for example, an OLED or a micro LED. OLED is an abbreviation for Organic Light Emitting Diode, and LED is an abbreviation for Light Emitting Diode. The micro LED is an inorganic LED integrated on a substrate. The anode of the light emitting element 31 is electrically connected to the node NDQ, and the cathode is electrically connected to the second ground line LVS2. When the digital data signal DDT stored in the digital driving circuit 36 is "0", the drive current flows to the light emitting element 31, and the light emitting element 31 emits light at a luminance corresponding to the current value of the drive current. When the digital data signal DDT stored in the digital driving circuit 36 is "1", the light emitting element 31 is turned off. Note that in the following description, when the light emitting element 31 is in a light-emitting state, this is also referred to as being "on", and when the light emitting element 31 is in a turned off state, this is also referred to as being "off".

Figure 5:
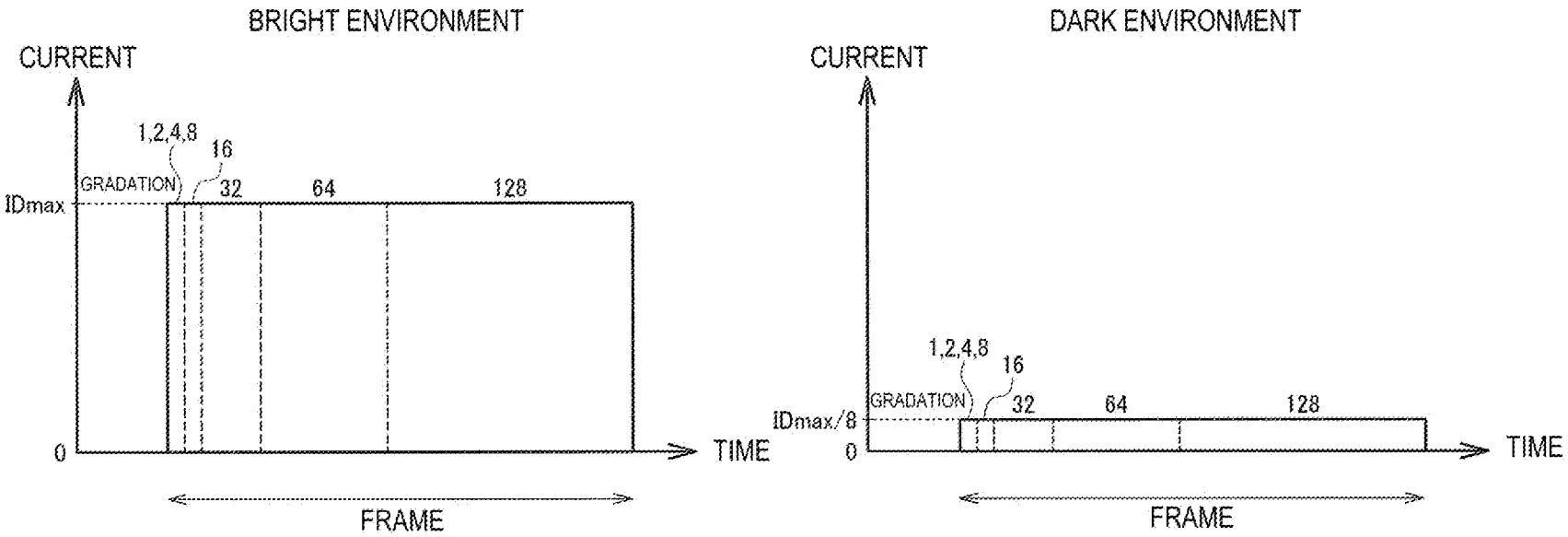
FIG. 5 is a diagram illustrating the display luminance adjustment according to an embodiment.

FIG. 5 is a diagram illustrating the display luminance adjustment in the embodiment. Similarly to the digital driving illustrated in FIG. 2, the pixel circuit 30 causes the light emitting element 31 to emit light in the display period of the length corresponding to the grayscale value, in one frame. The meaning of the numeral indicating the grayscale value, the fact that the interval delineated by dotted lines indicates the display period, and the fact that the length of the display period is weighted by the power of two are the same as in FIG. 2. However, in the embodiment, the analog driving circuit 35 controls the light emission luminance of the light emitting element 31 by controlling the drive current using the analog current setting.

As illustrated in the diagram on the left side, the analog data voltage ADT corresponding to a maximum current value IDmax in the bright environment is set to the analog driving circuit 35, and the analog driving circuit 35 outputs the drive current of the maximum current value IDmax. As illustrated in the diagram on the right side, the analog data voltage ADT corresponding to, for example, a current value IDmax/8 in the dark environment is set to the analog driving circuit 35, and the analog driving circuit 35 outputs the drive current of the current value IDmax/8. In this way, the light emission luminance in the dark environment is ⅛ of the light emission luminance in the bright environment. Note that it is assumed here that the light emission luminance is proportional to the current value, but when the light emission luminance is not linear with respect to the current value, the analog data voltage ADT may be set accordingly.

According to the embodiment, since the light emission luminance when the light emitting element 31 is on is adjusted, it is possible to use all the gradations of 0 to 255 even in the dark environment, and it is thus possible to both adjust the display luminance in accordance with brightness of the environment and achieve the favorable grayscale display. Further, even when it is assumed that the light emission luminance in the dark environment is one several hundredths of the light emission luminance in the bright environment, the drive current of approximately one gradation in the known analog driving illustrated in FIG. 1 is secured, and thus, the light emitting element 31 can emit the light in a stable manner.

Figure 6:
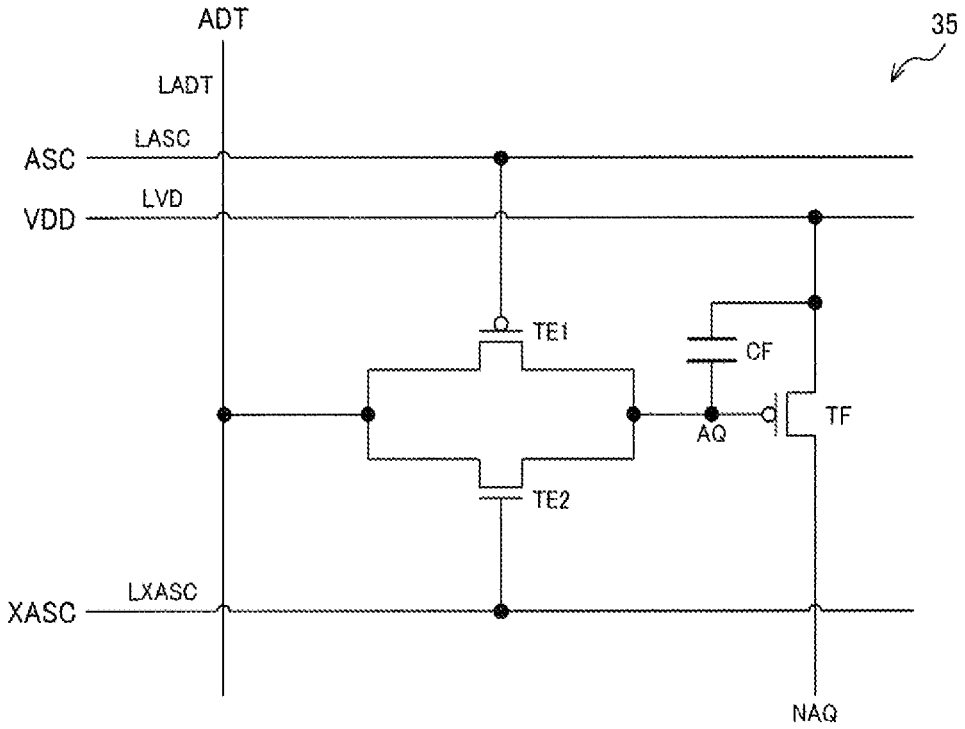
FIG. 6 is a first configuration example of an analog driving circuit.

FIG. 6 is a first configuration example of the analog driving circuit 35. The analog driving circuit 35 includes P-type transistors TE1 and TF, an N-type transistor TE2, and a capacitor CF. Note that in FIG. 6, in relation to ASC1 to ASCk, ADT1 to ADTm, and the like, 1 to k and 1 to m are omitted. For example, ASC refers any one of ASC1 to ASCk.

The P-type transistor TE1 and the N-type transistor TE2 are switch circuits provided between the analog signal line LADT and one end of the capacitor CF. Specifically, one of the source or drain of the P-type transistor TE1 and the N-type transistor TE2 is electrically connected to the analog signal line LADT, and the other is electrically connected to the gate of the P-type transistor TF. The gate of the P-type transistor TE1 is electrically connected to the analog scanning line LASC, and the gate of the N-type transistor TE2 is electrically connected to the analog inversion scanning line LXASC. The source of the P-type transistor TF is electrically connected to the power source line LVD, and the drain is electrically connected to the node NAQ. One end of the capacitor CF is electrically connected to the gate of the P-type transistor TF, and the other end is electrically connected to the source of the P-type transistor TF.

The capacitor CF holds the analog data voltage ADT input from the analog signal line LADT. The P-type transistor TF is a current supply transistor, and supplies, to the digital driving circuit 36, a drive current corresponding to the analog data voltage ADT held in the capacitor CF. A more detailed operation will be described with reference to FIG. 8.

Figure 7:
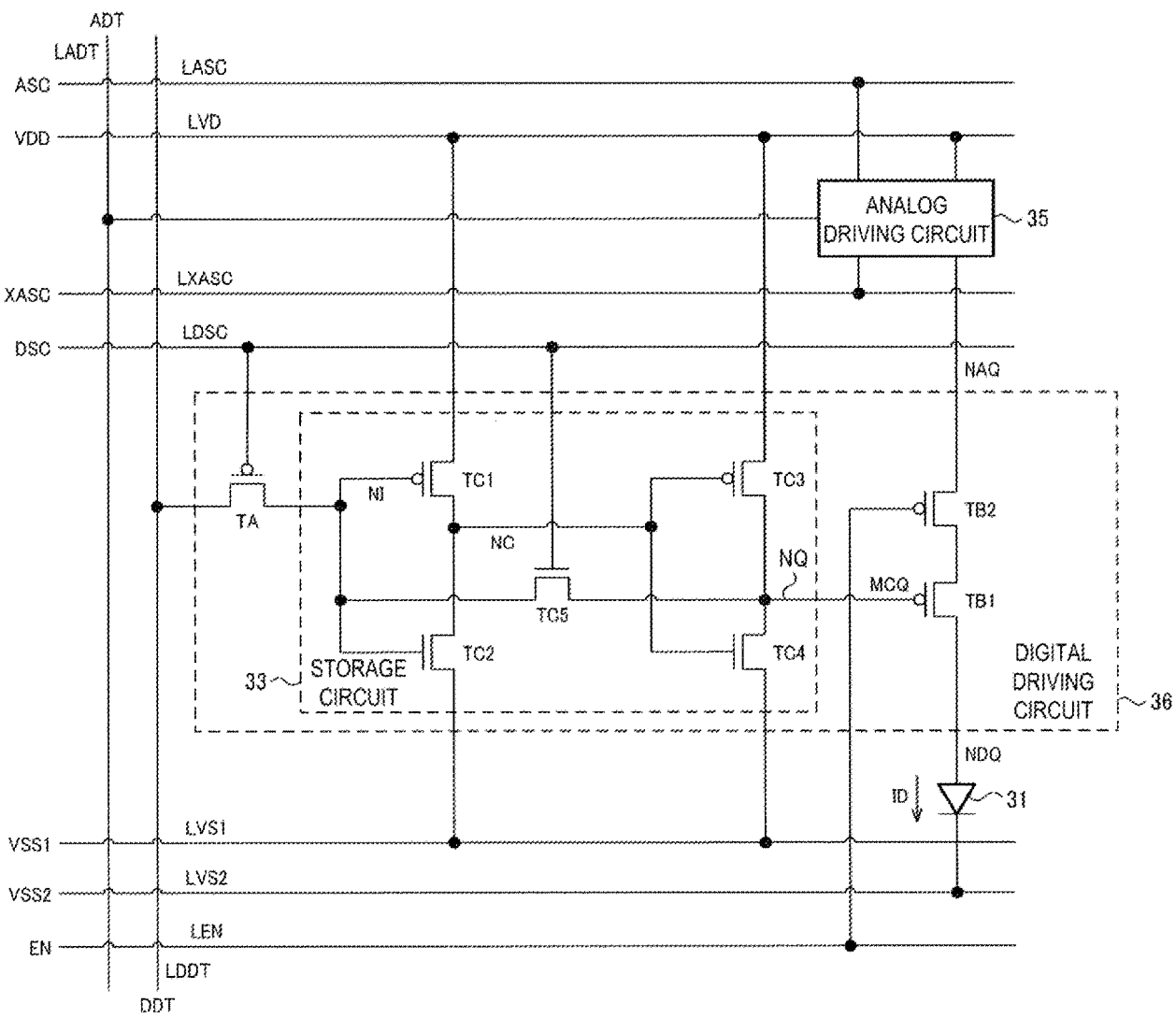
FIG. 7 is a configuration example of a digital driving circuit.

FIG. 7 is a configuration example of the digital driving circuit 36. The digital driving circuit 36 includes a storage circuit 33 and P-type transistors TA, TB1, and TB2. Note that in FIG. 7, in relation to DSC1 to DSCk, DDT1 to DDTm, and the like, 1 to k and 1 to m are omitted. For example, DSC refers to any one of DSC1 to DSCk.

One of the source or drain of the P-type transistor TA is electrically connected to the digital signal line LDDT, the other of the source or drain is electrically connected to an input node NI of the storage circuit 33, and the gate is electrically connected to the digital scanning line LDSC.

The source of the P-type transistor TB2 is electrically connected to the node NAQ, the drain is electrically connected to the source of the transistor TB1, and the gate is electrically connected to the enable signal line LEN. The drain of the P-type transistor TB1 is electrically connected to the node NDQ, and the gate is electrically connected to an output node NQ of the storage circuit 33. The P-type transistor TB1 is a drive transistor, is turned on or off based on an output signal MCQ from the storage circuit 33, and supplies the drive current to the light emitting element 31 when on.

The storage circuit 33 is a memory cell that stores one bit of data. The storage circuit 33 stores the digital data signal DDT input from the digital signal line LDDT to the input node NI when the P-type transistor TA is on, and outputs the stored signal to the output node NQ as the output signal MCQ. The storage circuit 33 includes P-type transistors TC1 and TC3, and N-type transistors TC2, TC4, and TC5.

The P-type transistor TC1 and the N-type transistor TC2 constitute a first inverter, and the P-type transistor TC3 and the N-type transistor TC4 constitute a second inverter. A power supply voltage VDD and a first ground voltage VSS1 are supplied to the first inverter and the second inverter. An input node of the first inverter is electrically connected to the input node NI of the storage circuit 33, an output node NC of the first inverter is electrically connected to an input node of the second inverter, and an output node of the second inverter is electrically connected to the output node NQ of the storage circuit 33. One of the source or drain of the N-type transistor TC5 is electrically connected to the input node NI, and the other of the source or drain is electrically connected to the output node NQ.

When "0" is set to the storage circuit 33, the output signal MCQ is at the low level, and when "1" is written, the output signal MCQ is at the high level. When the output signal MCQ and an enable signal EN of the storage circuit 33 are at the low level, the P-type transistors TB1 and TB2 are on, a drive current ID flows to the light emitting element 31, and the light emitting element 31 emits light. When at least one of the output signal MCQ or the enable signal EN of the storage circuit 33 is at the high level, at least one of the P-type transistors TB1 or TB2 is off, the drive current ID does not flow to the light emitting element 31, and the light emitting element 31 is turned off.

Note that the configuration of the digital driving circuit 36 is not limited to that illustrated in FIG. 7. For example, a capacitor may be provided in place of the storage circuit 33, and the capacitor may hold the digital data signal DDT. Alternatively, the N-type transistor TC5 of the storage circuit 33 may be omitted, and the input node NI of the first inverter and the output node NQ of the second inverter may be directly electrically connected to each other Alternatively, the ground lines LVS1 and LVS2 may be the common ground line, and the ground voltage may be supplied to the light emitting element 31 and the storage circuit 33 from the common ground line.

Figure 8:
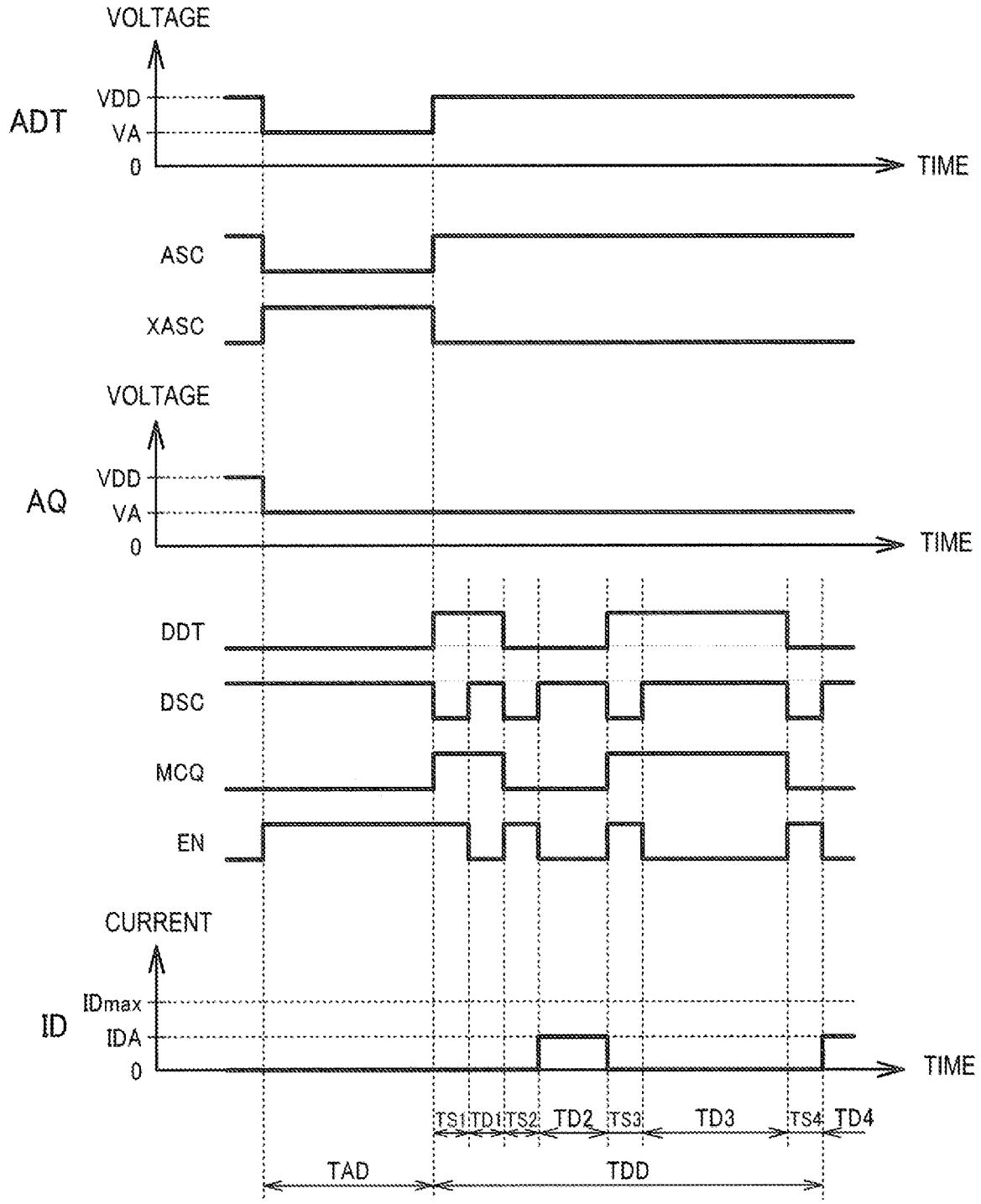
FIG. 8 is a diagram illustrating operations of the pixel circuit when using the first configuration example of the analog driving circuit.

FIG. 8 is a diagram illustrating operations of the pixel circuit 30 when using the first configuration example of the analog driving circuit 35. In FIG. 8, an example is illustrated in which the current value of the drive current ID is set to IDA<IDmax.

One frame includes a current setting period TAD during which the analog current setting is performed and a digital driving period TDD during which the digital driving is performed using the drive current set by the analog current setting.

In the current setting period TAD, the analog driving circuit 35 outputs an analog data voltage ADT=VA corresponding to a current value IDA. Further, the scanning line driving circuit 110 outputs the low level analog selection signal ASC and the high level analog inversion selection signal XASC. At this time, the P-type transistor TE1 and the N-type transistor TE2 of the analog driving circuit 35 are on, and a voltage AQ at one end of the capacitor CF becomes the analog data voltage ADT=VA. At the end of the current setting period TAD, the scanning line driving circuit 110 sets the analog selection signal ASC to the high level and the analog inversion selection signal XASC to the low level. At this time, the P-type transistor TE1 and the N-type transistor TE2 are turned off, and the voltage AQ=VA is held at the one end of the capacitor CF. In the current setting period TAD, the control line driving circuit 130 outputs the high level enable signal EN. In this way, the P-type transistor TB2 is off, and the light emitting element 31 is thus turned off.

In the digital driving period TDD subsequent to the current setting period TAD, the digital driving circuit 36 performs the digital driving. Here, an example will be given when a first bit of the display data is DDT [0]=1, a second bit is DDT [1]=0, a third bit is DDT [2]=1, and a fourth bit is DDT [3]=0.

In a scanning line selection period TS1, the digital selection signal DSC is at the low level. At this time, the P-type transistor TA of the digital driving circuit 36 is on, and the N-type transistor TC5 is off. In this way, the first bit DDT [0]=1 is input to the storage circuit 33, and the storage circuit 33 outputs the high level output signal MCQ. The enable signal EN is at the high level. As a result of the above, the P-type transistors TB1 and TB2 are off, and thus the light emitting element 31 is turned off.

In a display period TD1, the digital selection signal DSC is at the high level. At this time, the P-type transistor TA is off, and the N-type transistor TC5 is on. In this way, the storage circuit 33 holds the first bit DDT [0]=1, and holds the output signal MCQ at the high level. The enable signal EN is at the low level. As a result of the above, the P-type transistor TB1 is off and the P-type transistor TB2 is on, and thus the light emitting element 31 is turned off.

In a scanning line selection period TS2 and a display period TD2, the pixel circuit 30 operates in the same manner as described above. However, since DDT [1]=0, the light emitting element 31 is on in the display period TD2, and the drive current ID=IDA flows to the light emitting element 31. Similarly, since DDT [2]=1 and DDT [3]=0, the light emitting element 31 is turned off and on in the display periods TD3 and TD4, and the drive current ID=IDA flows to the light emitting element 31 in a display period TD4.

The length of the display period TD2 is twice the length of the display period TD1. Similarly, the lengths of the display periods TD3 and TD4 are twice the lengths of the display periods TD2 and TD3. In other words, the display periods TD1, TD2, TD3, and TD4 have a length proportional to the grayscale values 1, 2, 4, and 8 of the first, second, third, and fourth bits.

In the embodiment described above, the electro-optical device 15 includes the plurality of digital scanning lines LDSC1 to LDSCk, the plurality of analog scanning lines LASC1 to LASCk, the digital signal line LDDT, the analog signal line LADT, and the plurality of pixel circuits 30. The digital signal line LDDT is any one of LDDT1 to LDDTk, and the analog signal line LADT is any one of LADT1 to LADTm. Each of the pixel circuits 30 is electrically connected to the digital scanning line LDSC included in the plurality of digital scanning lines LDSC1 to LDSCk, the analog scanning line LASC included in the plurality of analog scanning lines LASC1 to LASCk, the digital signal line LDDT, and the analog signal line LADT. The digital scanning line LDSC is any one of LDSC1 to LDSCk, and the analog scanning line LASC is any one of LASC1 to LASCk.

Each of the pixel circuits 30 includes the light emitting element 31, the digital driving circuit 36, and the analog driving circuit 35. When the digital driving circuit 36 is selected through the digital scanning line LDSC, the display data from the digital signal line LDDT is set to the digital driving circuit 36, which supplies the drive current ID to the light emitting element 31 during the on period of the length corresponding to the grayscale value of that display data. This is referred to as the digital driving. When selected by the analog scanning line LASC, the analog data voltage ADT from the analog signal line LADT is set to the analog driving circuit 35, which variably sets the current value of the drive current ID based on the analog data voltage ADT. This is referred to as the analog current setting.

Of the plurality of pixel circuits 30, the pixel circuit 30 electrically connected to the s-th digital scanning line LDSCs and the s-th analog scanning line LASCs is the s-th pixel circuit. Of the plurality of pixel circuits 30, the pixel circuit 30 electrically connected to the t-th digital scanning line LDSCt and the t-th analog scanning line LASCt, is the t-th pixel circuit. s and t are integers equal to or greater than 1. In a period in which the s-th pixel circuit performs the analog current setting, the t-pixel circuit performs the digital driving.

For example, in FIG. 12 to be described below, A to which hatching is applied refers to the analog current setting, and the numerals 1, 2, 4, and 8 refer to the digital driving. When s=1, the pixel circuits of the first scanning line perform the analog current setting in a selection order 1 to 4, and the pixel circuits of the second to 17th scanning lines perform the digital driving. t may be any one of 2 to 17.

According to the embodiment, the analog driving circuit 35 variably adjusts the drive current ID, and the drive current ID causes the digital driving circuit 36 to perform the digital driving of the light emitting element 31. In this way, the light emission luminance when the light emitting element 31 is on is adjusted, and it is thus possible to use all the gradations of 0 to 255 in the dark environment. As a result, it is possible to both adjust the display luminance in accordance with the brightness of the environment and achieve the favorable grayscale display. Further, as illustrated in FIG. 5, the light emitting element 31 can emit the light in the stable manner even in the dark environment.

Further, according to the embodiment, the analog scanning line LASC and the analog signal line LADT are provided with respect to the analog driving circuit 35, and the digital scanning line LDSC and the digital signal line LDDT are provided with respect to the digital driving circuit 36. In this way, it is possible to independently control the analog current setting and the digital driving, and when the analog current setting is performed in a given scanning line, the digital driving can be performed in another scanning line. When the analog current setting and the digital driving cannot be controlled independently, for example, the scanning lines are sequentially set one by one to the analog current setting, and during that time, the digital driving is not performed, and the digital driving is performed after the analog current setting has ended for all of the scanning lines. Since the length of one frame is determined by a frame rate, the digital driving period in one frame is shortened, and a scanning line driving frequency increases correspondingly. According to the embodiment, it is not necessary to separate the analog current setting and the digital driving, it is thus possible to perform the digital driving over the entire one frame, and the scanning line driving frequency can therefore be reduced.

Further, in the embodiment, the electro-optical device 15 includes the scanning line driving circuit 110 that drives the plurality of digital scanning lines LDSC1 to LDSCk and the plurality of analog scanning lines LASC1 to LASCk. A field constituting one image includes the current setting period TAD in which the analog current setting is performed and the digital driving period TDD in which the digital driving is performed. The digital driving period includes first to n-th scanning line selection periods in which the first to n-th bits of display data are set to the pixel circuit 30, and first to n-th display periods in which the light emitting element 31 is on or off in accordance with the first to n-th bits set to the pixel circuit 30. n is an integer equal to or greater than 2. The above-described on period is a display period in which the light emitting element 31 is on during the first to n-th display periods.

In the example illustrated in FIG. 8, n=4, TS1 to TS4 correspond to the first to fourth scanning line selection periods, and TD1 to TD4 correspond to the first to fourth display periods. The second display period TD2 and the fourth display period TD4 in which the light emitting element 31 is on are the on periods of the length corresponding to the grayscale value of the display data.

According to the embodiment, in the digital driving period TDD, the light emitting element 31 emits the light in the on period of the length corresponding to the grayscale value of the display data. The light emission luminance averaged over time in one frame is determined by a ratio of the on period occupying the one frame, and is thus the luminance obtained by dividing up the maximum luminance by the grayscale value. As a result of the drive current ID of the light 31 being adjusted in the current setting period TAD, the maximum luminance of the light emitting element 31 is determined. As a result, the display brightness adjustment can be made without reducing the display gradation.

Further, in the embodiment, the digital driving circuit 36 turns off the light emitting element 31 during the current setting period TAD.

As described above, in the embodiment, when the given scanning line performs the analog current setting, the other scanning lines can perform the digital driving. In other words, although the light emitting element is off in the scanning line that performs the analog current setting, the display can be performed by the digital driving in the other scanning lines. When the analog current setting and the digital driving cannot be controlled independently, when the given scanning line performs the analog current setting, the light emitting element of that scanning line is off, and at the same time, the other scanning lines are not capable of performing the digital driving. Thus, the display is off. As a result, there is a period in which the display of the entire screen is off in one frame, which is a cause of flickering of the display, and the like. According to the embodiment, there is no period in which the display of the entire screen is off, and thus, the flickering of the display or the like can be reduced.

Further, in the embodiment, the current setting period TAD in the s-th pixel circuit electrically connected to the s-th analog scanning line LASCs overlaps with any one of the first to n-th scanning line selection periods in the t-th pixel circuit electrically connected to the t-th digital scanning line LDSCt.

For example, in FIG. 12 to be described later, sections in which the numerals 1, 2, 4, and 8 are surrounded by dotted lines indicate the first scanning line selection period, the second scanning line selection period, the third scanning line selection period, and the fourth scanning line selection period. When s=1, in the selection order 1 to 4, the first scanning line is set to the current setting period TAD, and in the selection order 1, 2, 3, 4, the 17-th scanning line, the 16-th scanning line, the 14-th scanning line, and the 10-th scanning line are set to the first scanning line selection period, the second scanning line selection period, the third scanning line selection period, and the fourth scanning line selection period. t may be any of 17, 16, 14, and 10.

The scanning line selection period is a period in which bits of the display data are set to the storage circuit 33 of the digital driving circuit 36. According to the embodiment, the analog scanning line LASC and the analog signal line LADT are provided with respect to the analog driving circuit 35, and the digital scanning line LDSC and the digital signal line LDDT are provided with respect to the digital driving circuit 36, In this way, the scanning line selection period and the current setting period TAD can be caused to overlap.

3. Second Configuration Example of Electro-optical Device and Display System

FIG. 9 is a second configuration example of the electro-optical device 15 and the display system 10. In the second configuration example, the pixel circuit 30 performs the threshold compensation, and the analog driving circuit 35 is omitted. Hereinafter, portions different from the first configuration example will be mainly described, and a description of portions that are the same as those of the first configuration example will be omitted as appropriate.

The pixel array 20 includes the pixel circuits 30 in k rows and m columns, compensation control signal lines LDS1 to LDSk and LAZ1 to LAZk, reference voltage lines LVRF1 to LVRFm, the analog scanning lines LASC1 to LASCk, the digital scanning lines LDSC1 to LDSCk, the enable signal lines LEN1 to LENk, the analog signal lines LADT1 to LADTm, the digital signal lines LDDT1 to LDDTm, the power source line LVD, and the ground lines LVS1 and LVS2.

One end of each of the analog signal lines LADT1 to LADTm is commonly electrically connected to a node of the analog data voltage VADT. In other words, the common analog data voltage VADT is applied to the analog signal lines LADT1 to LADTm.

The compensation control signal lines LDS1 and LAZ1 are electrically connected to the pixel circuit 30 in the first row, the control line driving circuit 130 outputs a compensation control signal DS1 to the compensation control signal line LDS1, and outputs a compensation control signal AZ1 to the compensation control signal line LAZ1. Similarly, the compensation control signal lines LDS2 to LDSk and LAZ2 to LAZk are electrically connected to the pixel circuits 30 in the second to the k-th rows, the control line driving circuit 130 outputs compensation control signals DS2 to DSk to the compensation control signal lines LDS2 to LDSk, and outputs compensation control signals AZ2 to AZk to the compensation control signal lines LAZ2 to LAZk.

The reference voltage line LVRF1 is electrically connected to the pixel circuit 30 in the first column. Similarly, the reference voltage lines LVRF2 to LVRFm are electrically connected to the pixel circuits 30 in the second to the m-th column. The display signal supply circuit 61 outputs a reference voltage VFR. One end of each of the reference voltage lines LVRF1 to LVRFm is commonly electrically connected to a node of the reference voltage VFR, and the common reference voltage VFR is applied to the reference voltage lines LVRF1 to LVRFm. Note that, similarly to the analog data voltage VADT, a voltage generation circuit (not illustrated) or the like may output the reference voltage VRF.

The pixel circuit 30 includes the analog driving circuit 35, the digital driving circuit 36, and the light emitting element 31. The configuration of the digital driving circuit 36 is the same as that of FIG. 7. In the second configuration example, the configuration of the analog driving circuit 35 is different.

Figure 10:
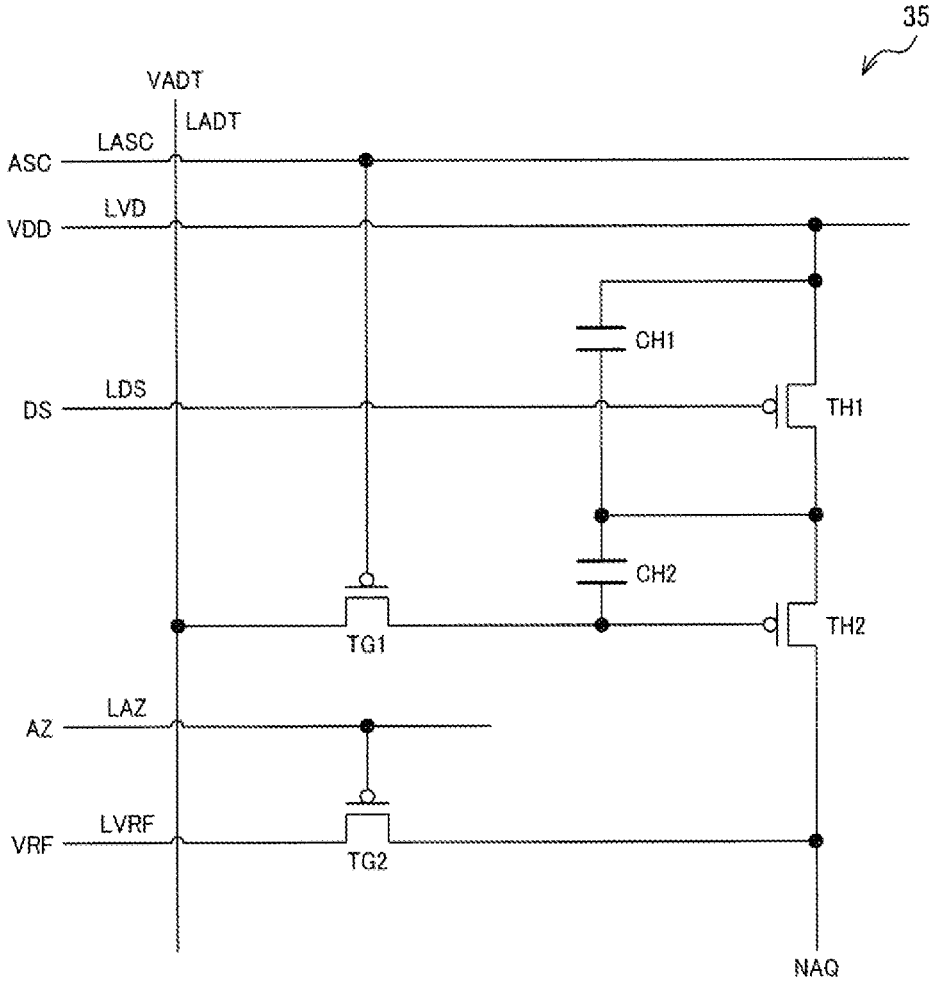
FIG. 10 is a second configuration example of the analog driving circuit.

FIG. 10 is a second configuration example of the analog driving circuit 35. The analog driving circuit 35 includes P-type transistors TG1, TG2, TH1, and TH2, and capacitors CH1 and CH2. Note that in FIG. 10, in relation to ASC1 to ASCk, ADT1 to ADTm, and the like, 1 to k and 1 to m are omitted. For example, ASC refers any one of ASC1 to ASCk.

The P-type transistor TG1 is a switching circuit provided between the analog signal line LADT and one end of the capacitor CH2. Specifically, one of the source or drain of the P-type transistor TG1 is electrically connected to the analog signal line LADT, and the other is electrically connected to the gate of the P-type transistor TH2 and the one end of the capacitor CH2. The gate of the P-type transistor TG1 is electrically connected to the analog scanning line LASC.

One of the source or drain of the P-type transistor TG2 is electrically connected to the reference voltage line LVRF, and the other is electrically connected to the node NAQ. The gate of the P-type transistor TG1 is electrically connected to the compensation control signal line LAZ.

The source of the P-type transistor TH1 is electrically connected to the power source line LVD, and the drain is electrically connected to the source of the P-type transistor TH2 and the other end of the capacitor CH2. One end of the capacitor CH1 is electrically connected to the drain of the P-type transistor TH1 and the other end of the capacitor CH2, and the other end is electrically connected to the power source line LVD. The drain of the P-type transistor TH2 is electrically connected to the node NAQ.

The capacitor CH2 holds the analog data voltage VADT. The P-type transistor TH2 is a current supply transistor, and supplies a drive current corresponding to the analog data voltage VADT held in the capacitor CH2 to the digital driving circuit 36. Note that a more detailed operation will be described with reference to FIG. 11.

Figure 11:
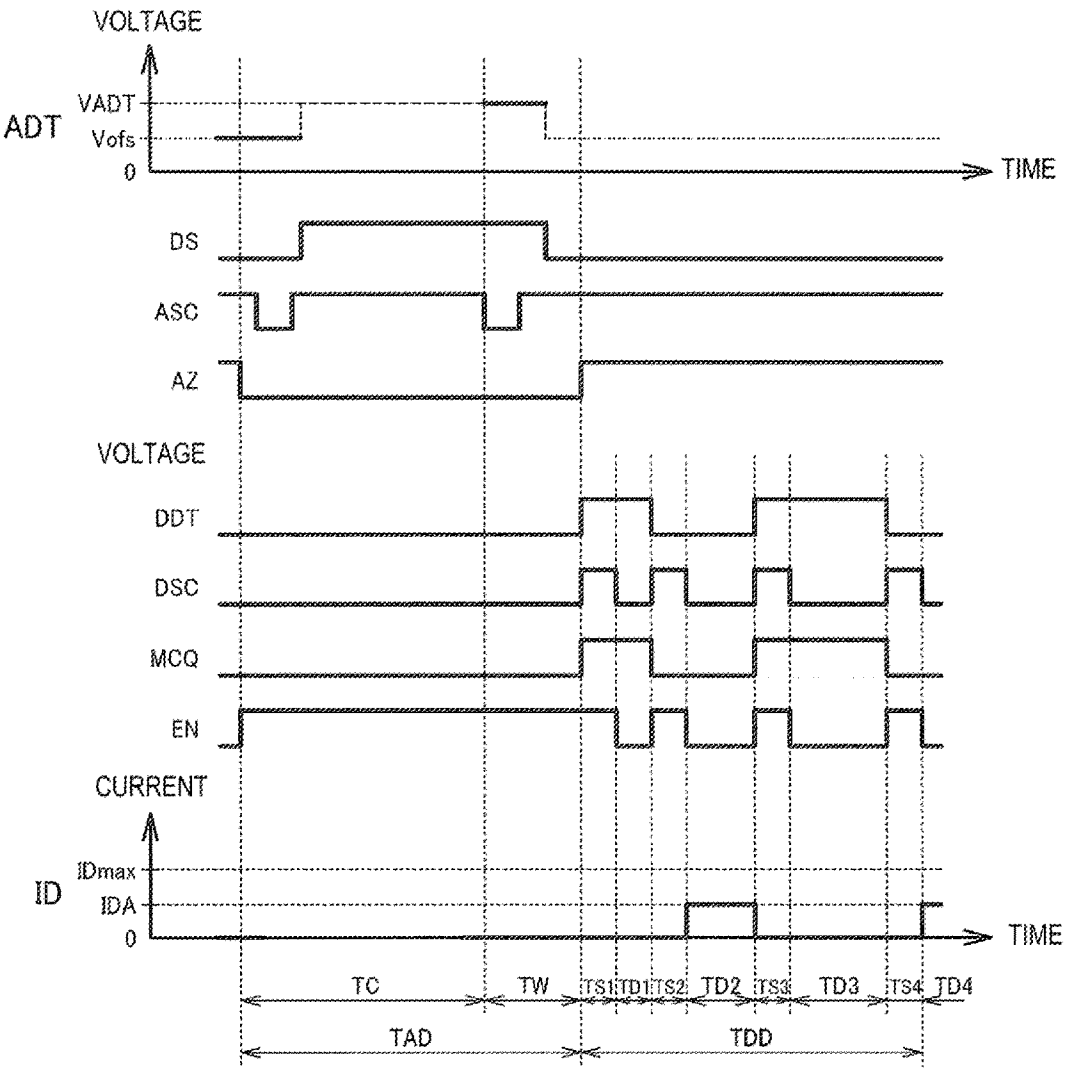
FIG. 11 is a diagram illustrating operations of the pixel circuit when using the second configuration example of the analog driving circuit.

FIG. 11 is a diagram illustrating operations of the pixel circuit 30 when using the second configuration example of the analog driving circuit 35. FIG. 11 illustrates an example in which the current value of the drive current ID is set to IDA<IDmax.

One frame includes a current setting period TAD during which the analog current setting is performed and a digital driving period TDD during which the digital driving is performed using the drive current set by the analog current setting. The operations in the digital driving period TDD are the same as those illustrated in FIG. 8.

In the current setting period TAD, the control line driving circuit 130 outputs the low level compensation control signal AZ. In this way, the P-type transistor TG2 is on, and the reference voltage VFR is applied to the node NAQ.

The current setting period TAD is divided into a threshold value compensation period TC and a subsequent write period TW. In the threshold compensation period TC, first, the analog data voltage VADT is set to an offset voltage Vofs. At this time, the control line driving circuit 130 outputs the low level compensation control signal DS. In this way, the P-type transistor TH1 is on and the power supply voltage VDD is applied to the other end of the capacitor CH2. In this state, the scanning line driving circuit 110 switches the analog selection signal ASC from the high level to the low level. The P-type transistor TG1 is turned from off to on, and the offset voltage Vofs is applied to the one end of the capacitor CH2. The scanning line driving circuit 110 switches the analog selection signal ASC from the low level to the high level, the P-type transistor TG1 is turned from on to off, and the capacitor CH2 holds a potential difference of VDD−Vofs. After that, the control line driving circuit 130 switches the compensation control signal DS from the low level to the high level. In this way, the P-type transistor TH1 is turned from on to off. Since the offset voltage Vofs is applied to the gate of the P-type transistor TH2, the current flows to the P-type transistor TH2, the source voltage of the P-type transistor TH2 decreases, and the voltage of the gates electrically connected by the capacitor CH2 also drops. At this time, an electric charge reflecting the threshold voltage of the P-type transistor TH2 is held in the capacitors CH1 and CH2.

In the write period TW, the analog data voltage VADT is set to VA. The scanning line driving circuit 110 switches the analog selection signal ASC from the high level to the low level. The P-type transistor TG1 is turned from off to on, and the analog data voltage VADT=VA is applied to the one end of the capacitor CH2. The scanning line driving circuit 110 switches the analog selection signal ASC from the low level to the high level, and the P-type transistor TG1 is turned from on to off. After that, the control line driving circuit 130 switches the compensation control signal DS from the high level to the low level. In this way, the P-type transistor TH1 is turned on from off to on. In this process, the electric charge reflecting the threshold voltage of the P-type transistor TH2 is held in the capacitors CH1 and CH2, and in this way, the gate voltage of the P-type transistor TH2 is caused to be a threshold-compensated analog data voltage.

In the current setting period TAD, the control line driving circuit 130 outputs the high level enable signal EN. In this way, the P-type transistor TB2 is off, and the light emitting element 31 is thus turned off. At the end of the current setting period TAD, the control line driving circuit 130 switches the compensation control signal AZ from the low level to the high level. In this way, the P-type transistor TG2 is turned from on to off.

4. First Example of Scanning Line Selection Order

Above, the configuration and operations of the single pixel circuit are mainly described, but below, a method will be described for driving the pixel array 20 of k rows and m columns. Note that a plurality of examples described below can be implemented in combination with each other as appropriate.

Figure 12:
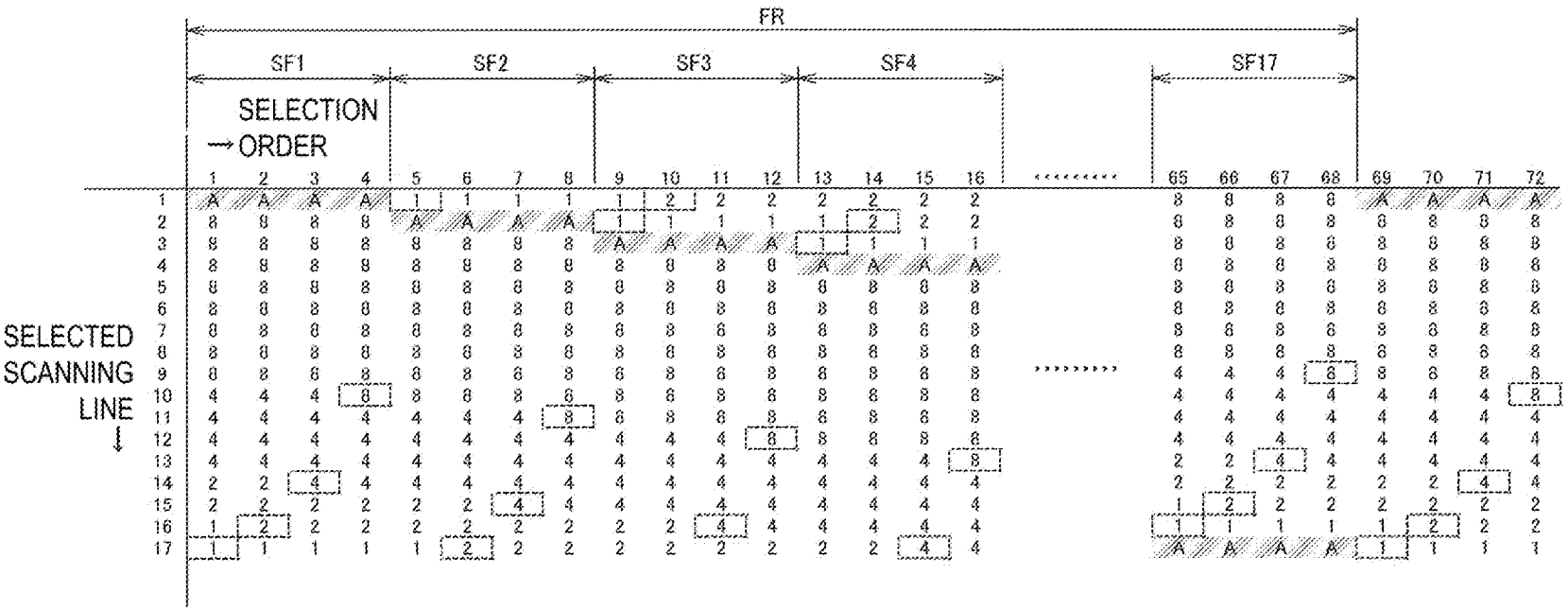
FIG. 12 is a first example of a scanning line selection order.

FIG. 12 is a first example of the scanning line selection order according to the embodiment. Here, a case will be described in which a total number of the scanning lines included in the pixel array 20 is k=17, and a number of bits of the display data is n=4. The first to fourth bits are assumed to be from the LSB side of the display data. Note that, when the first to 17-th scanning lines are simply referred to, this indicates the pixel circuits in the first to 17-th rows in the pixel array. Then, the digital scanning lines and analog scanning lines that are electrically connected to the pixel circuits in the first to 17-th rows are referred to as the first to 17-th digital scanning lines and the first to 17-th analog scanning lines.

In FIG. 12, the horizontal axis of the table is the selection order, and one time in the selection order corresponds to the selection of one of the digital scanning lines. In other words, the one time in the selection order corresponds to one horizontal scanning period. The vertical axis of the table indicates the number of the scanning line, and these are in order of 1 to 17 in a vertical scanning direction. The number listed in each cell of the table indicates the grayscale value of each bit of the display data. In other words, 1, 2, 4, and 8 refer to the first bit, the second bit, the third bit, and the fourth bit. The cells surrounded by the dotted lines refer to the scanning line selection period in the digital driving. In other words, the number surrounded by the dotted lines means that the bit corresponding to that number is set to the pixel circuit electrically connected to the selected digital scanning line. The cells that are not surrounded by the dotted lines refer to the display period in the digital driving. Further, the cells that are hatched and denoted by A refer to the current setting period in which the analog current setting is performed.

First, the first scanning line will be described as an example for the operations when focusing on one scanning line. The analog driving circuit of the first scanning line performs the analog current setting in the selection order 1 to 4. The analog driving circuit of the first scanning line performs the digital driving in the subsequent selection order 5 to 68. In the selection order 5, the first digital scanning line is selected, and the first bit is set to the digital driving circuit. In the subsequent selection order 6 to 9, the light emitting element is turned on or off based on the first bit held in the digital driving period. Similarly, the first digital scanning line is selected in the selection order 10, 19, and 36, and the second bit, the third bit, and the fourth bit are set to the digital driving circuit. In the subsequent selection order 11 to 18, 20 to 35, and 37 to 68, the light emitting element is turned on or off based on the second bit, the third bit, and the fourth bit held in the digital driving circuit. Note that the length of the selection order 1 to 4, which is the current setting period, is equivalent to a length of one of subfields to be described below. The length of the selection order 5 to 68, which is the digital driving period, is equivalent to a length of 16 of the subfields to be described below.

In the above description, in the digital driving period in one field, the first to fourth scanning line selection periods and the first to fourth display periods are provided corresponding to the first to fourth bits. In the first scanning line, the first to fourth scanning line selection periods are periods corresponding to the selection order 5, 10, 19, and 36, and the first to fourth display periods are periods corresponding to the selection order 6 to 9, 11 to 18, 20 to 35, and 37 to 68. The lengths of the first to fourth display periods are 4h, 8h, 16h, and 32h. Whether any given selection order corresponds to the scanning line selection period or the display period differs depending on each of the scanning lines, but the first to fourth scanning line selection periods and the first to fourth display periods are the same in terms of being provided for each of the scanning lines.

Next, operations when scanning the 17 scanning lines will be described. FR is a field, and one frame is constituted by one field. In other words, the field FR is a period constituting one image, and is a period required for writing the display data corresponding to the one image to all of the pixels. Note that the same field FR is defined for all of the scanning lines based on the selection order in any one of the scanning lines. For example, in FIG. 12, the field FR is defined based on the selection order in the first scanning line. Thus, the image data set to the pixel array 20 in the field FR is not precisely the image data clearly delineated for the one image, but corresponds to one image in terms of the image data amount. In this sense, the field FR is the period constituting the one image.

The field FR includes subfields SF1 to SF17 corresponding to the 17 scanning lines. When the length of the scanning line selection period is h, the length of each of the subfields is 4h corresponding to the four bits of the display data.

First, the analog current setting will be described. The scanning line driving circuit 110 selects one of the analog scanning lines in each of the subfields, and the pixel circuit electrically connected to the selected analog scanning line performs the analog current setting. In one selection order, only one of the scanning lines performs the analog current setting. However, when the threshold compensation is performed, a plurality of the scanning lines may perform the analog current setting in one selection order. This point is described below in a second example and the like.

Next, the digital driving will be described. Since the analog current setting and the digital driving can be performed independently, in one selection order, it is possible for the given scanning line to perform the analog current setting and for the other scanning lines to perform the digital driving.

In each of the subfields, the scanning line driving circuit 110 selects a scanning line group that is a selection target among the first to 17-th digital scanning lines. In FIG. 12, the scanning line group is constituted by the four digital scanning lines that are the same as the four bits of the display data. Of those four digital scanning lines, the first bit is set to the pixel circuit electrically connected to one of the digital scanning lines, the second bit is set to the pixel circuit electrically connected to another of the digital scanning lines, the third bit is set to the pixel circuit electrically connected to yet another of the digital scanning lines, and the fourth bit is set to the pixel circuit of yet another of the digital scanning lines. For example, in the subfield SF1, the 17-th digital scanning line, the 16-th digital scanning line, the 14-th digital scanning line, and the 10-th digital scanning line are the scanning line group, and the first bit, the second bit, the third bit, and the fourth bit are set to the pixel circuits electrically connected to those scanning lines.

The four digital scanning lines belonging to the scanning line group are respectively selected in a different selection order. In the sub-field SF1 illustrated in FIG. 12, the 17-th digital scanning line, the 16-th digital scanning line, the 14-th digital scanning line, and the 10-th digital scanning line belonging to the scanning line group are respectively selected in the selection order 1, 2, 3, and 4.

When advancing by one subfield, the number of the digital scanning lines belonging to the scanning line group increases by one. In other words, a selection order pattern in the subfield moves by an amount corresponding to one scanning line in a downward direction of a screen. This pattern movement is performed in a cyclical manner. In other words, the selection order pattern of the 17-th scanning line in a given subfield is the selection order pattern of the first scanning line in the subsequent subfield. For example, in the subfield SF2, the first digital scanning line, the 17-th digital scanning line, the 15-th digital scanning line, and the 11-th digital scanning line are the scanning line group, and the first bit, the second bit, the third bit, and the fourth bit are set to the pixel circuits electrically connected to those scanning lines. This is because the selection order pattern in the subfield SF1 has moved downward by one scanning line in the cyclical manner.

In the subfield SF1, the first to fourth bits are set to the 17-th scanning line, the 16-th scanning line, the 14-th scanning line, and the 10-th scanning line. In terms of spacing between the scanning lines, the 16-th scanning line is one scanning line before the 17-th scanning line, the 14-th scanning line is two scanning lines before the 16-th scanning line, and the 10-th scanning line is four scanning lines before the 14-th scanning line. In the subsequent subfield SF2, the first bit is set to the first scanning line, and this is 8+1 scanning lines before the 10-th scanning line. In this way, the first to fourth display periods have lengths proportional to the grayscale values. Specifically, a description will be given when focusing on the display period in the 17-th scanning line. First, the second bit is set to the 16-th scanning line in the selection order 2, and this selection order pattern moves to the 17-th scanning line after one subfield. Since the length of the sub-field is 4h and the first display period of the 17-th scanning line starts from the selection order 2, the length of the first display period is 1×4h. Next, the third bit is set to the 15-th scanning line in the selection order 7, and this selection order pattern moves to the 17-th scanning line after two subfields. Since the second display period of the 17-th scanning line starts from the selection order 7, the length of the second display period is 2×4h=8h. Similarly, the length of the third display period is 4×4h. The length of the fourth display period is 8×4h, which is obtained by subtracting the length 1×4h of the current setting period from (8+1)×4h.

Since the total number of scanning lines is 17 and the writing of the four bits is required per scanning line, the total number of scanning lines in one field is 17×4=68. In FIG. 12, one field is constituted by the selection order 1 to 68, and the same selection order pattern as that selection order pattern is repeated in the selection order 69 to 136 in the next field. The same selection order pattern is repeated in each field in the same manner, for the selection order of 137 and onward. Note that an exact formula for the total number of scanning line selections will be described later.

In the embodiment described above, the field FR includes the plurality of subfields SF1 to SF17. In the subfields included in the plurality of subfields SF1 to SF17, the scanning line driving circuit 110 selects the one scanning line group that is the selection target, from among the plurality of digital scanning lines LDSC1 to LDSCk. The scanning line group includes the digital scanning line electrically connected to the pixel circuit 30 to which an i-th bit is written in the subfield, and the digital scanning line electrically connected to the pixel circuit 30 to which a j-th bit is written in the subfield. i is an integer equal to or greater than 1 and equal to or less than n, and j is an integer equal to or greater than 1 and equal to or less than n, and is different to i.

For example, when i=1 and j=2, in the subfield SF1 in FIG. 12, the first bit is set to the 17-th scanning line, and the second bit is set to the 16-th scanning line. In other words, in the subfield SF1, the scanning line group includes the 17-th scanning line and the 16-th scanning line.

In JP-A-2019-132941 and JP-A-2008-281827 described above, while selecting a plurality of scanning lines one by one in descending order, a given bit is set to a pixel electrically connected to each of the selected scanning lines. Following this, up to when the writing of a next bit is started, a period occurs in which the scanning line is not selected. Since the length of one frame is determined by the frame rate, there is an issue in that the scanning line drive frequency increases as a result of the period being present in which the scanning line is not selected. According to the embodiment, the i-th bit is set to the one scanning line in the one subfield, and the j-th bit is set to another of the scanning lines. In this way, a non-scanning period in which the scanning line is not selected can be reduced, and the scanning line drive frequency can be decreased compared to the known method. As a result of the scanning line drive frequency decreasing, it is possible to reduce power consumption in the scanning line driving, or to write the data to the pixel circuit in a reliable manner. Alternatively, when considered from the point of view of the scanning line drive frequency being the same as that of the known method, in the one frame, more of the scanning lines can be selected. In other words, a higher definition electro-optical device can be driven without increasing the scanning line drive frequency compared to the known method.

Here, the plurality of subfields SF1 to SF17 are the subfields included in the field FR, and specifically, the plurality of subfields are obtained by dividing the field FR into the plurality of periods. Further, the plurality of digital scanning lines are the digital scanning lines for constituting the scanning line selection order pattern, and the number of the digital scanning lines is not limited to the number of scanning lines actually present in the electro-optical device. In FIG. 12, the scanning line selection order pattern is constituted by the 17 scanning lines. At this time, the number of scanning lines actually present in the electro-optical device may be 17, or may be less than 17. For example, when the number of scanning lines actually present in the electro-optical device is 14, the selection order pattern of the first to 17-th scanning lines is present as internal processing of the circuit device 100, but the 15-th to 17-th scanning lines are not actually driven. Further, selecting the scanning line group in the sub-field one time means that, in the sub-field, each of the digital scanning lines belonging to the scanning line group is selected one time. At this time, the one scanning line is selected in the same selection order, and two or more of the scanning lines are not selected at the same time.

Further, in the embodiment, each of the subfields of the plurality of subfields SF1 to SF17 is a period of the same length. In the subfield, the scanning line driving circuit 110 selects, as the scanning line group, the n digital scanning lines, from the digital scanning line electrically connected to the pixel circuit 30 to which the first bit is to be set to set to the digital scanning line electrically connected to the pixel circuit 30 to which the n-th bit is to be written. In that subfield, the scanning line driving circuit 110 selects the analog scanning line of the pixel circuit 30 electrically connected to the digital scanning line different from the n digital scanning lines described above.

For example, in the subfield SF1 illustrated in FIG. 12, the first bit, the second bit, the third bit, and the fourth bit are set to the 17-th scanning line, the 16-th scanning line, the 14-th scanning line, and the 10-th scanning line. In other words, in the subfield SF1, the scanning line group is the 17-th scanning line, the 16-th scanning line, the 14-th scanning line, and the 10-th scanning line, and includes the four scanning lines. Then, the analog current setting is performed on the first scanning line that is different from those four scanning lines.

Each of the subfields being the period of the same length means that the number of scanning lines of the selected scanning line group is the same in each of the subfields. Then, the same number of scanning lines as the number of bits of the display data are selected while being shifted for each of the subfields until one cycle is completed. As a result, the first to n-th bits are written into all of the scanning lines in the one frame. In FIG. 12, the four scanning lines are selected in each of the subfields, the pattern thereof is shifted by one scanning line for each of the subfields, and the one cycle is completed by the 17 subfields. In this way, the first to fourth bits are set to the 17 scanning lines in the one frame. Then, in each of the subfields, the analog current setting is performed on the scanning line different from the scanning line group. In this way, the analog current setting is performed in the 17 scanning lines in the 17 subfields in the one frame. Note that, as in a fourth example to be described below, the number of the scanning lines in which the analog current setting is performed in one subfield may be two or more.

Further, in the embodiment, the length of the current setting period TAD is the length of one or a plurality of the subfields. In FIG. 12, the length of the current setting period TAD is one subfield, but as in the fourth example to be described below, the length of the current setting period TAD may be 2 subfields or more.

According to the embodiment, the length of the current setting period TAD can be freely set, and thus, a write time of the analog data voltage can be sufficiently secured in response to an increase in the number of pixels of a display panel, and the like. As described above, in the embodiment, when the given scanning line performs the analog current setting, the other scanning lines can perform the digital driving. Therefore, even if the current setting period TAD becomes long, an effect on the display is small, and further, the scanning line selection frequency of the digital driving is also substantially unchanged.

Further, in the embodiment, in the field FR, of the plurality of digital scanning lines LDSC1 to LDSCk, the scanning line driving circuit 110 selects each of the scanning lines n times each, and thus, the first to n-th bits of display data are set to each of the pixel circuits.

Specifically, when the scanning line driving circuit 110 selects the digital scanning line n times, in the selection each time, the digital signal line driving circuit 120 writes one bit of the first to n-th bits to the pixel circuit electrically connected to the selected digital scanning line. At this time, in the n number of selections, the digital signal line driving circuit 120 writes the first to n-th bits so that the first to n-th bits do not overlap with each other. In FIG. 12, for example, the first scanning line is selected four times in the selection order 5, 10, 19, and 36, and the first, second, third, and fourth bits are set to the first scanning line, respectively.

As described above, when focusing on the one scanning line, the first to n-th scanning line selection periods and the first to n-th display periods are necessary in the one field. According to the embodiment, each of the scanning lines is selected n times, and the first to n-th bits are set to those scanning lines. In this way, in the one field, the first to n-th scanning line selection periods and the first to n-th display periods are realized for all of the scanning lines.

5. Second Example of Scanning Line Selection Order

Figure 13:
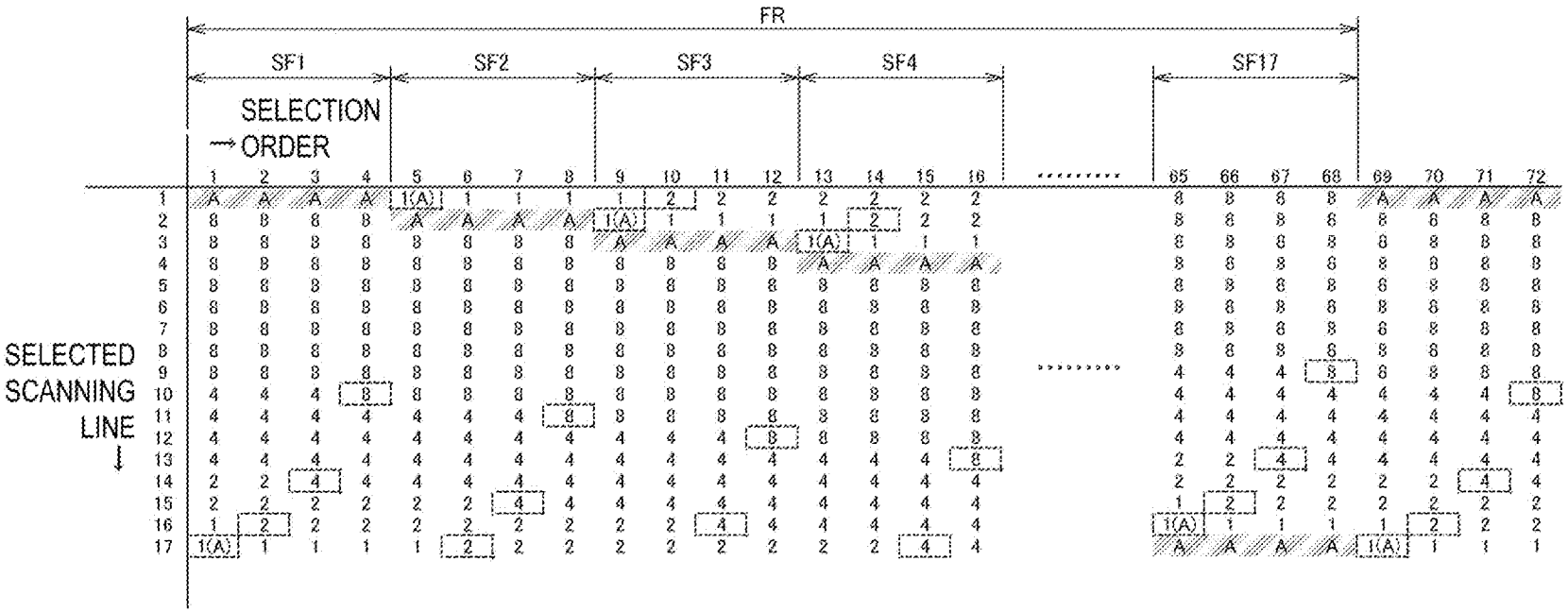
FIG. 13 is a second example of the scanning line selection order.

FIG. 13 is the second example of the scanning line selection order according to the embodiment. In the first example, the analog current setting is not performed during the digital driving period, but in the second example, the analog current setting is also performed in some of the digital driving periods.

Taking the first scanning line as an example, the selection order 1 to 5 is the current setting period. Of the selection order 1 to 5, in the selection order 1 to 4, only the analog current setting is performed, and in the selection order 5, the analog current setting and the writing of the first bit in the digital driving are performed. The selection order 5 corresponds to the first scanning line selection period of the digital driving. In FIG. 13, this overlap is denoted by 1(A).

As illustrated in FIG. 11, the current setting period TAD when the threshold compensation is performed includes the threshold compensation period TC and the write period TW. In one selection order, when only one scanning line is set for the write period TW, the plurality of scanning lines may be set to the current setting period TAD. For example, in the selection order 5, the first scanning line and the second scanning line are set to the current setting period. In this selection order 5, the first scanning line is set to the write period TW, and the second scanning line is set to the threshold value compensation period TC. In the second example, the length of the current setting period is 5h, but for example, if the first 3h is allocated to the threshold compensation period TC and the subsequent 2h is allocated to the write period TW, in the one selection order, only the one scanning line is set to the write period TW.

In the embodiment described above, the current setting period includes the first scanning line selection period. In the first scanning line selection period, the analog driving circuit 35 performs the analog current setting at the same time that the first bit of the display data is set to the digital driving circuit 36.

According to the embodiment, the analog current setting and the digital driving can be independently controlled, and thus, the current setting period can be extended up to the first scanning line selection period. From the first display period, in order to cause the light to be emitted at the drive current set by the analog current setting, it is appropriate to extend the current setting period up to the first scanning line selection period. By extending the current setting period, the write time of the analog data voltage can be extended.

6. Third Example of Scanning Line Selection Order

Figure 14:
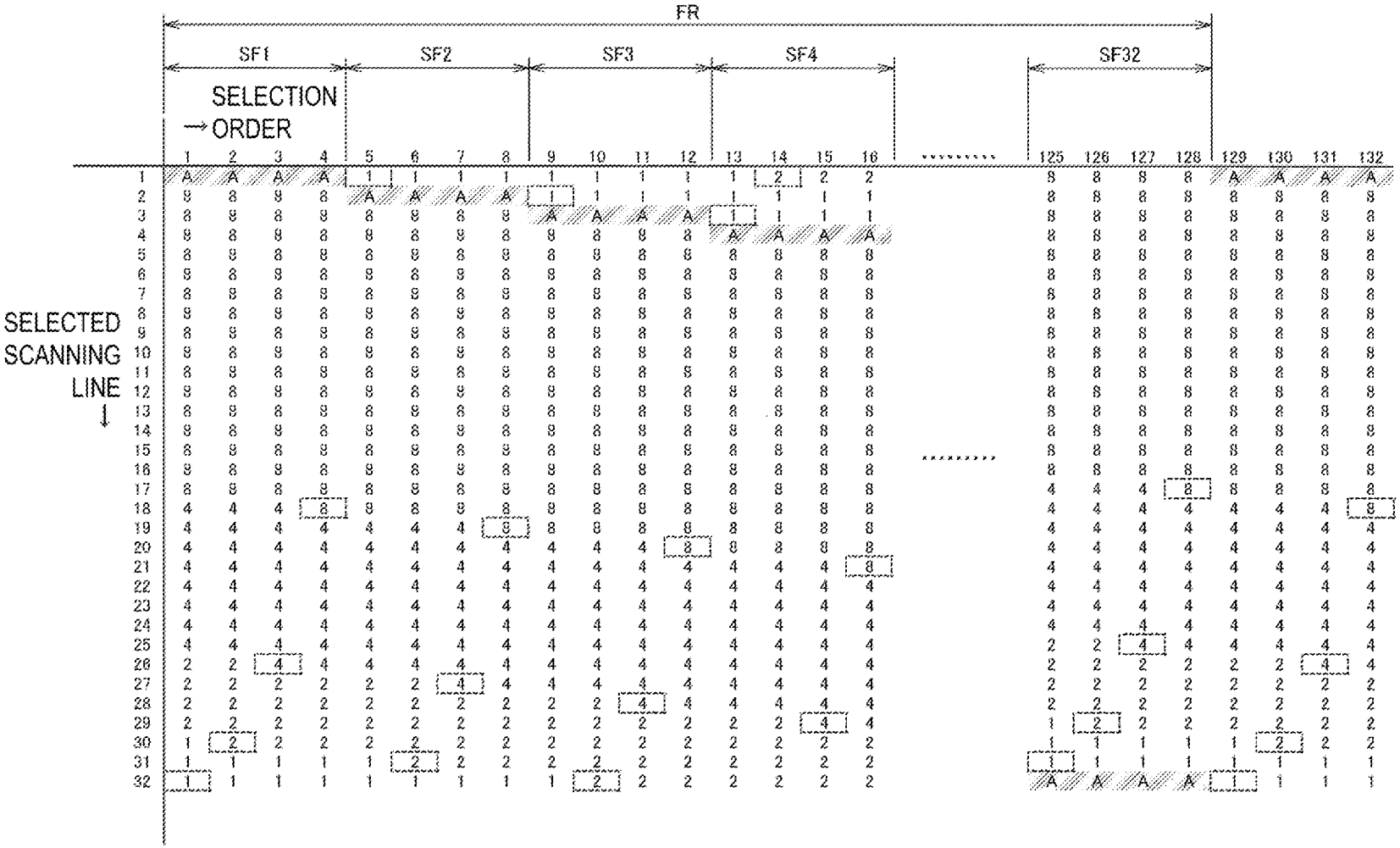
FIG. 14 is a third example of the scanning line selection order.

FIG. 14 is a third example of the scanning line selection order according to the embodiment. In the first example, the display period of the first bit in the digital driving is 4h, which corresponds to the one subfield, but in the third example, the display period of the first bit in the digital driving is 2×4h, which corresponds to two of the subfields.

In the third example, the number of scanning lines is 32, and the total number of scanning lines in the field FR is 32×4 bits=128 times. Hereinafter, where the total number of scanning line selections is Nfr, a formula for determining Nfr will be described.

A number obtained by dividing the length of the display period of the first bit by the length of the subfield is defined as a multiple a. a is an integer equal to or greater than 1. In the first and second examples, a=1, and in the third example, a=2. A period other than the digital driving period in one frame is a non-digital driving period. The non-digital driving period includes the current setting period. As in a fifth example to be described below, the non-digital driving period may further include a non-emitting period other than the current setting period. A number obtained by dividing the length of the non-digital driving period of the first bit by the length of the subfield is defined as b. In the first to third examples, b=1. The number of bits of the display data is defined as n. In the first to third examples, n=4. At this time, Formula (1) below is established.

$$Nfr=((2^n-1)\times a+1)\times n+b\times n \quad (1)$$

Further, the number k of the scanning lines is obtained by Formula (2) below.

$$k=Nfr/n=((2^n-1)\times a+1)+b \quad (2)$$

When n=4, a=2, b=1 in the third example are inserted, $Nfr=((2^4-1)\times 2+1)\times 4+1\times 4=128$, and k=128/4=32 are obtained, which are consistent with FIG. 14. Further, in the first and second examples, $Nfr=((2^4-1)\times 1+1)\times 4+1\times 4=68$, and k=68/4=17 are obtained, which are consistent with FIG. 12 and FIG. 13.

According to the embodiment, in a range in which the number k of the scanning lines can be an integer, the number of bits n of the display data, the multiple a indicating the length of the display period of the first bit, and the variable b indicating the length of the non-digital driving period can be freely adjusted. In this way, the embodiment can be applied to display panels having varying numbers of pixels. Further, since the variable b is variable, the length of the current setting period can be freely adjusted, and even in a high definition display panel or the like, the write time of the analog data voltage can be sufficiently secured.

7. Fourth Example of Scanning Line Selection Order

Figure 15:
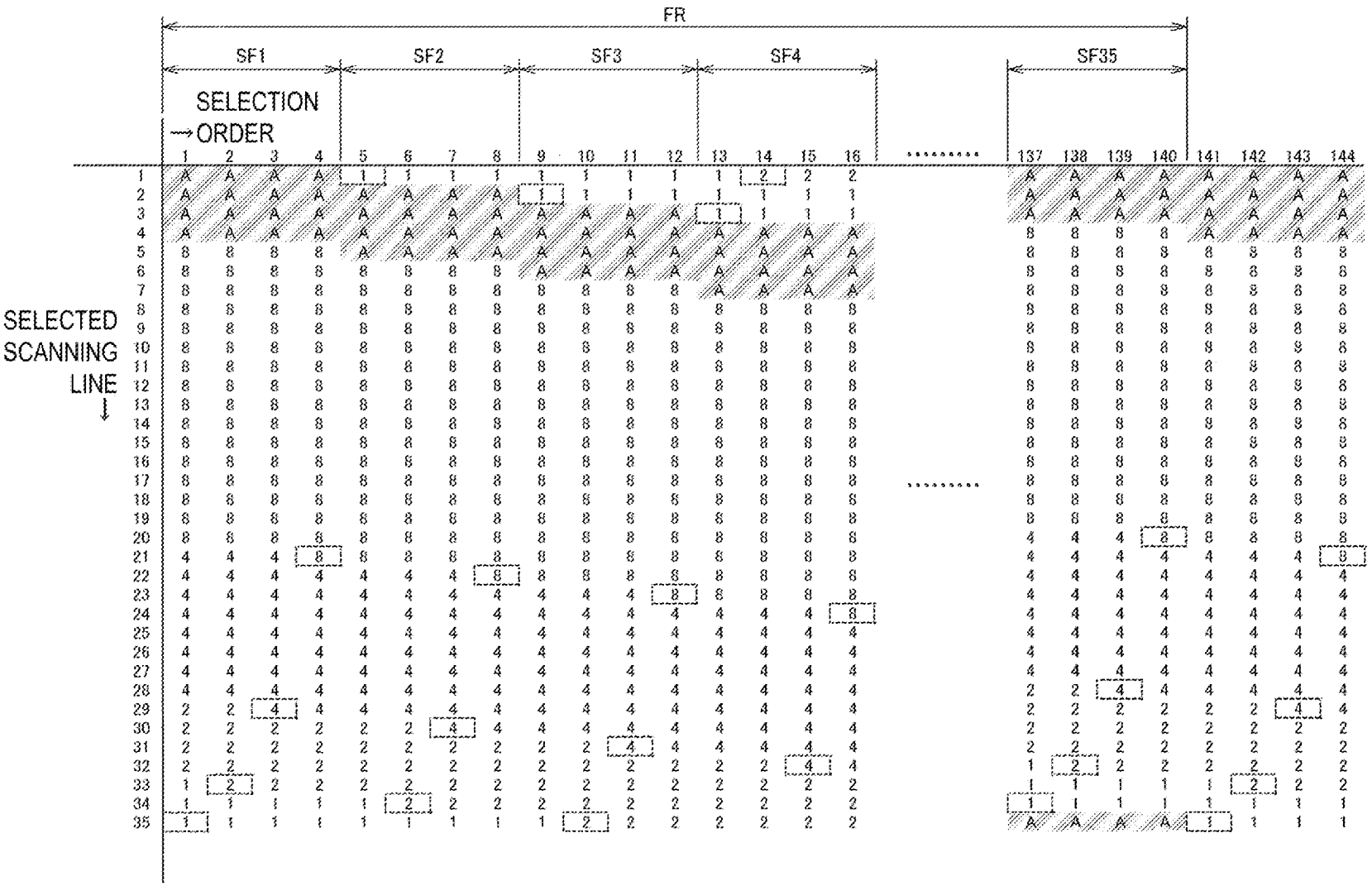
FIG. 15 is a fourth example of the scanning line selection order.

FIG. 15 is a fourth example of the scanning line selection order according to the embodiment. In the third example, the length of the current setting period is the length of the one subfield, but in the fourth example, the length of the current setting period is the length of four of the subfields.

In the fourth example, n=4, a=2, and b=4, and when the above Formula (1) and Formula (2) are used, the total number of scanning line selections $Nfr=((2^4-1)\times 2+1)\times 4+4\times 4=140$, and the number of scanning lines k=140/4=35.

The analog current setting is performed in the four scanning lines in the one subfield, but of those, on one of the scanning lines is set to the write period TW illustrated in FIG. 11. In the fourth example, the current setting period is the four subfields, but, for example, of the four subfields, the first three subfields may be set to the threshold value compensation period TC, and the subsequent one subfield may be set to the write period TW.

8. Fifth Example and Sixth Example of Scanning Line Selection Order

In the first example, the non-digital driving period is only the current setting period, but in the fifth example and a sixth example, the non-digital driving period may include the current setting period and the non-emitting period.

Figure 16:
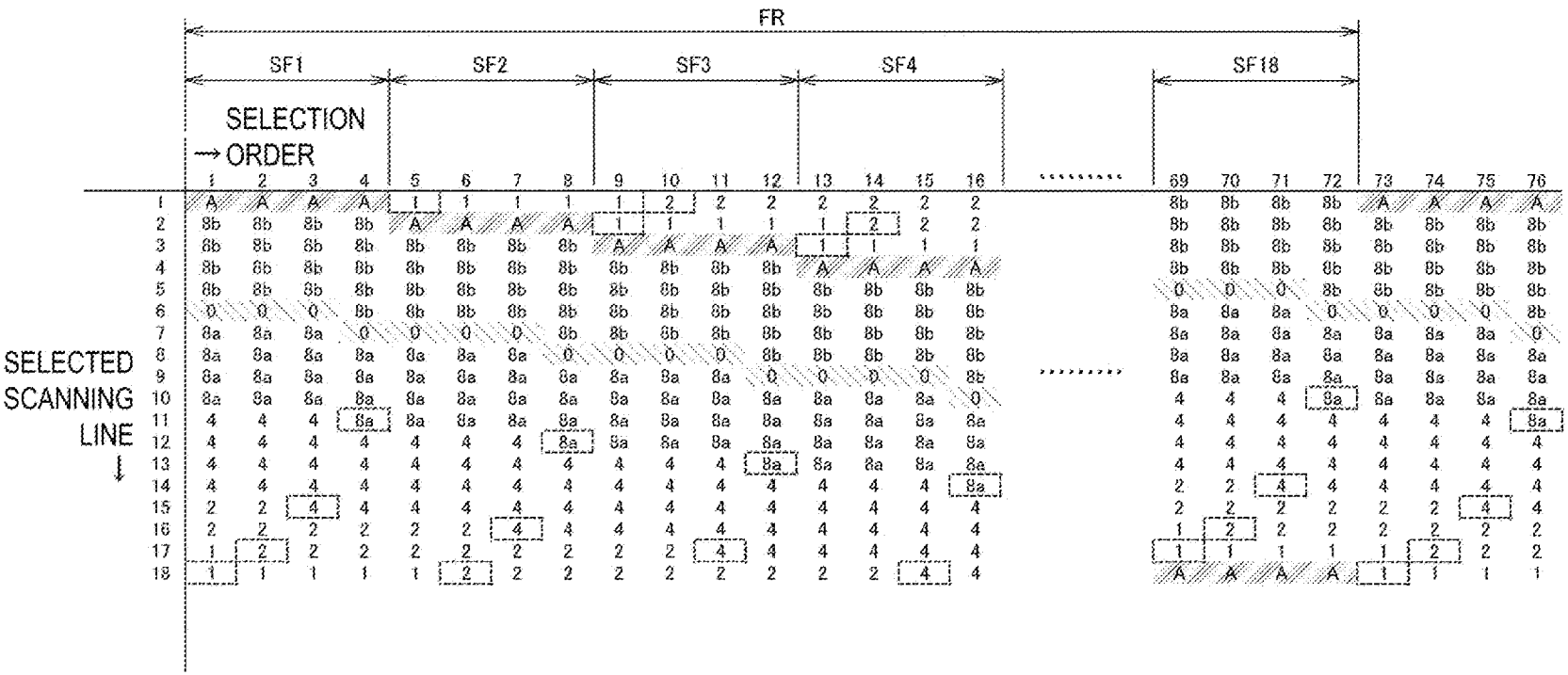
FIG. 16 is a fifth example of the scanning line selection order.

FIG. 16 is the fifth example of the scanning line selection order according to the embodiment. In the fifth example, the fourth display period, which is the display period of the fourth bit, is divided into a first fourth display period denoted by 8a and a second fourth display period denoted by 8b. Then, between those periods, the non-emitting period is provided that is indicated by hatching and 0. Note that 8a surrounded by a dotted line indicates the fourth scanning line selection period. The control line driving circuit 130 sets the enable signal EN to the low level in the first fourth display period and the second fourth display period, and turns on the light emitting element 31. The control line driving circuit 130 sets the enable signal EN to the high level in the non-emitting period and turns off the light emitting element 31. In the non-emitting period, the storage circuit 33 of the digital driving circuit 36 holds the fourth bit.

Note that in the fifth example, the non-emitting period is provided in the fourth display period, but the non-emitting period may be provided in any of the first to fourth display periods. Further, the non-emitting period may be provided in two or more of the display periods.

In the fifth example, n=4, a=1, and b=2, and when the above Formula (1) and Formula (2) are used, the total number of scanning line selections $Nfr=((2^4-1)\times 1+1)\times 4+2\times 4=72$, and the number of scanning lines k=72/4=18.

In the embodiment described above, the field FR includes the digital driving period, the current setting period, and the non-emitting period. A β-th display period of the first to n-th display periods is divided into a first β-th display period and a second β-th display period. β is an integer equal to or greater than 1 and equal to or less than n. In the example illustrated in FIG. 16, n=4, and β=4. The non-emitting period is provided between the first β-th display period and the second β-th display period. The digital driving circuit 36 turns off the light emitting element 31 during the non-emitting period.

When the light emitting element continues to be turned on for a long period of time in the frame, there is a possibility that the light emitting element may flicker when a video appearing on the screen is viewed. According to the embodiment, the relatively long display period can be divided into the two display periods, and thus the flickering of the video can be reduced.

Figure 17:
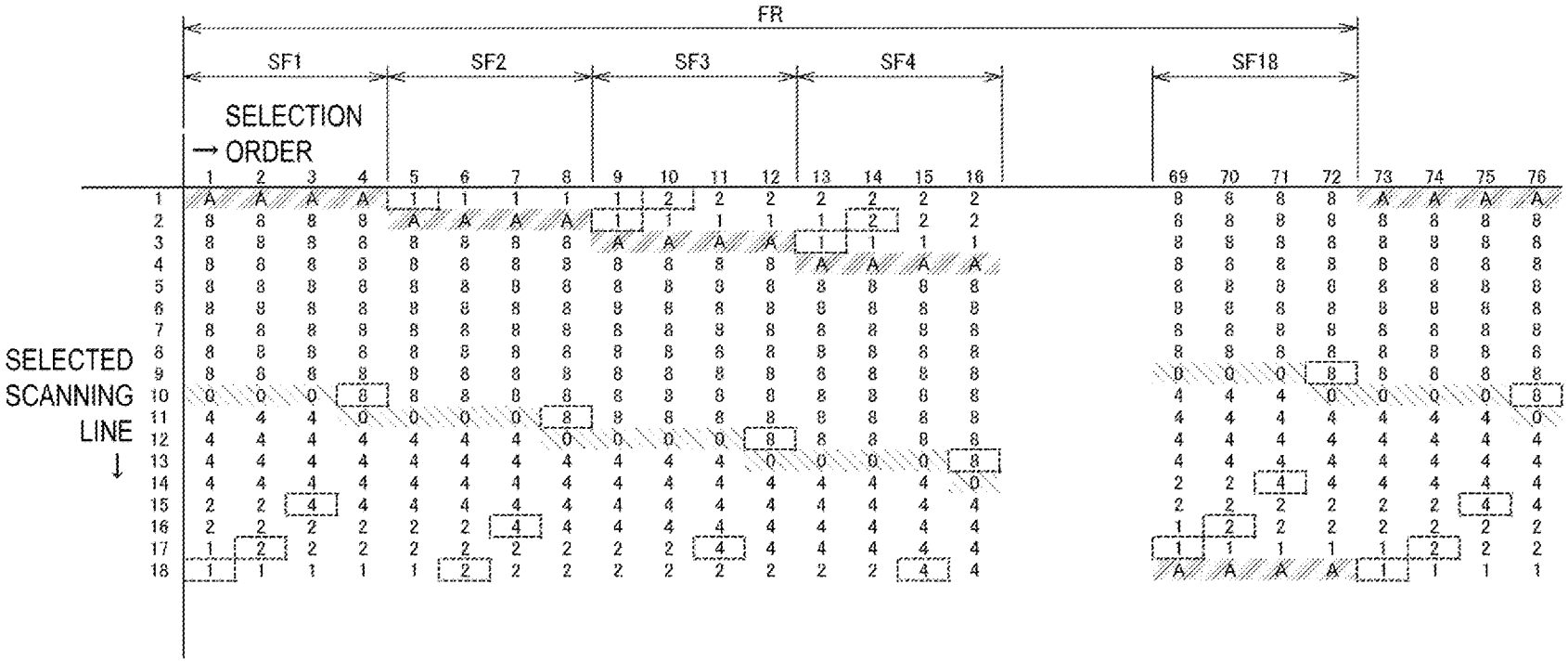
FIG. 17 is a sixth example of the scanning line selection order.

FIG. 17 is the sixth example of the scanning line selection order according to the embodiment. In the sixth example, the non-emitting period indicated by the hatching and denoted by 0 is provided between the third display period, which is the display period of the third bit, and the fourth scanning line selection period, which is the scanning line selection period of the fourth bit. The control line driving circuit 130 sets the enable signal EN to the high level in the non-emitting period and turns off the light emitting element 31.

Note that in the sixth example, the non-emitting period is provided between the third display period and the fourth scanning line selection period, but a non-emitting period may be provided between the first display period and the second scanning line selection period, or between the second display period and the third scanning line selection period. Further, the non-emitting period may be provided at two or more of those locations.

In the sixth example, n=4, a=1, and b=2, and when the above Formula (1) and Formula (2) are used, the number of total scanning line selections $Nfr=((2^4-1)\times 1+1)\times 4+2\times 4=72$ and the number of scanning lines k=72/4=18.

In the embodiment described above, the field FR includes the digital driving period, the current setting period, and the non-emitting period. The non-emitting period is provided between the α-th display period of the first to n-th display periods and the α+1-th scanning line selection period of the first to n-th scanning line selection periods. Here, α is an integer equal to or greater than 1 and equal to or less than n−1. In the example illustrated in FIG. 17, n=4 and α=3. The digital driving circuit 36 turns off the light emitting element 31 during the non-emitting period.

When the light emitting element is consecutively on in the two adjacent display periods, the on state of the light emitting element continues for a long time in the frame. According to the embodiment, the non-emitting period is provided between the two adjacent display periods, and thus the time over which the light emitting element is continuously on can be shortened. In this way, the flickering of the video can be reduced.

9. Seventh Example of Scanning Line Selection Order

In a seventh example, an example in which the embodiment is applied to full high vision will be described. In Formula (1) and Formula (2) above, when n=5, a=35, and b=3, the total number of scanning line selections $Nfr=((2^5-1)\times35+1)\times5+3\times5=5445$, and the number of scanning lines k=5445/5=1089. Since the number of scanning lines in full high vision is 1080, nine of the scanning lines are dummy scanning lines.

When the frame rate is 60 Hz, the one selection period is h=1/60/5445=3 μsec, and the current setting period is 15h=46 μsec. Since n=5, the length of the one subfield is 5h=15 μsec and is the same as the horizontal scanning period 1/60/1080=15 μsec in the normal analog driving. In other words, the current setting period in the embodiment is the same as the horizontal scanning period in the known analog driving, and it is thus possible to secure the write time of the analog data voltage in the same manner as in the known analog driving. This is because the current setting period can be set using the variable b. When the number of pixels in the display panel increases or the display frame rate increases, the write time becomes more insufficient. However, in the embodiment, the current setting period can be freely set, and thus a sufficient write time can be secured.

10. Electronic Apparatus

Figure 18:
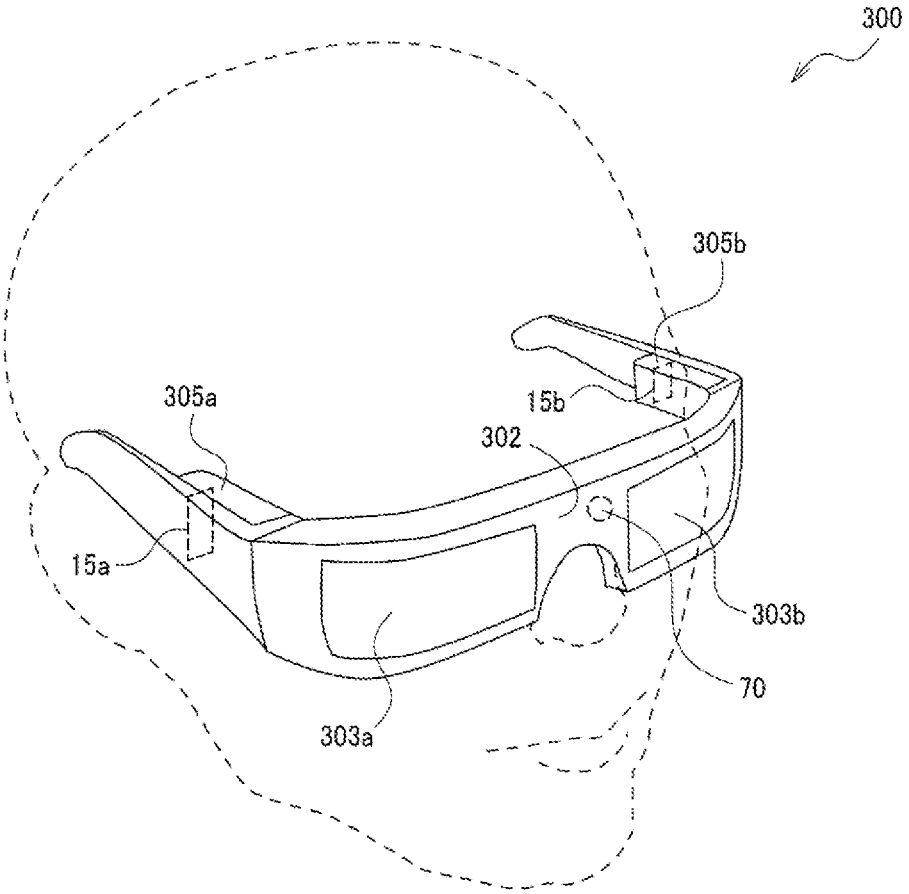
FIG. 18 is a configuration example of an electronic apparatus.

FIG. 18 is a configuration example of an electronic apparatus 300 that includes electro-optical devices 15*a* and 15*b*. Each of the electro-optical devices 15*a* and 15*b* corresponds to the electro-optical device 15 illustrated in FIG. 3 or FIG. 9. Here, a case in which the electronic apparatus is a head-mounted display is described as an example, but the present disclosure is not limited thereto, and various devices for displaying video using the electro-optical device can be assumed as the electronic apparatus. For example, the electronic apparatus may be an electronic viewfinder, a projector, a head-up display, a personal digital assistant, a television device, an on-board display, or the like.

The head-mounted display has an eyeglass-like appearance and allows the user wearing the head-mounted display to view image light superimposed on external light. The electronic apparatus 300 that is the head-mounted display includes transparent members 303*a* and 303*b*, a frame 302, projection devices 305*a* and 305*b*, and a sensor 70.

The frame 302 supports the transparent members 303*a* and 303*b* and the projection devices 305*a* and 305*b*. By mounting the frame 302 on the user's head, the head-mounted display is mounted on the user's head. The transparent member 303*a* is provided at a right eye portion of the frame 302, and the transparent member 303*b* is provided at a left eye portion of the frame 302. The transparent members 303*a* and 303*b* transmit the external light, thus allowing the user to view the external light. The projection device 305*a* is provided from a right temple portion to the right eye portion of the frame 302, and the projection device 305*b* is provided from a left temple portion to the left eye portion of the frame 302. The projection devices 305*a* and 305*b* cause light to be incident on the user's eyes so that the image light superimposed on the external light is visible to the user.

The projection device 305*a* includes the electro-optical device 15 *a*. As described with reference to FIG. 3, the electro-optical device 15*a* includes the circuit device 100 and the pixel array 20. The projection device 305*a* includes an optical system (not illustrated) that causes the image displayed in the pixel array 20 to be incident on the user's eye. The optical system includes, for example, a lens and a light-guiding member that reflects image light on an inner surface thereof. A configuration is adopted in which the image light is focused by refraction by the lens, and by curvature by a reflective surface of the light-guiding member. Similarly, the projection device 305*b* includes the electro-optical device 15*b* and an optical system (not illustrated).

The sensor 70 measures the luminance information of the environment. The sensor 70 is provided, for example, on a coupling portion that couples the right eye portion and the left eye portion of the frame 302. The sensor 70 is, for example, a photodiode, but an image sensor provided for photography may also serve as the sensor 70. In this case, the luminance information is acquired from an image captured by the image sensor.

The electro-optical device according to the embodiment described above includes the plurality of digital scanning lines, the plurality of analog scanning lines, the digital signal line, the analog signal line, and the plurality of pixel circuits. Each of the pixel circuits is electrically connected to one of the digital scanning lines included in the plurality of digital scanning lines, one of the analog scanning lines included in the plurality of analog scanning lines, the digital signal line, and the analog signal line. Each of the pixel circuits includes the light emitting element, the digital driving circuit, and the analog driving circuit. The digital driving circuit performs the digital driving to cause the display data to be set through the digital signal line when selected through the digital scanning line, and to supply the drive current to the light emitting device in the on period of the length corresponding to the grayscale value of the display data. The analog driving circuit performs the analog current setting to cause the analog data voltage to be set through the analog signal line when selected by the analog scanning line, and to variably set the current value of the drive current based on the analog data voltage. In the period in which, of the plurality of pixel circuits, the s-th pixel circuit electrically connected to the s-th digital scanning line and the s-th analog scanning line performs the analog current setting, of the plurality of circuits, the t-th pixel circuit electrically connected to the t-th digital scanning line and the t-th analog scanning line performs the digital driving. s is an integer equal to or greater than 1, and t is an integer equal to or greater than 1 and different from s.

According to the embodiment, the analog driving circuit variably adjusts the drive current, and the drive current causes the digital driving circuit to perform the digital driving of the light emitting element. In this way, the light emission luminance when the light emitting element is on is adjusted, and thus it is possible to use all of the gradations even in the dark environment. As a result, it is possible to both adjust the display luminance in accordance with the brightness of the environment and achieve the favorable grayscale display. Further, according to the embodiment, the analog scanning line and the analog signal line are provided with respect to the analog driving circuit, and the digital scanning line and the digital signal line are provided with respect to the digital driving circuit. In this way, it is possible to independently control the analog current setting and the digital driving, and when the analog current setting is performed in the given scanning line, the digital driving can be performed in the other scanning line. In this way, it is not necessary to separate the analog current setting and the digital driving, and thus it is possible to perform the digital driving over the entire one frame, and to reduce the scanning line drive frequency.

Further, in the embodiment, the electro-optical device may include the scanning line driving circuit that drives the plurality of digital scanning lines and the plurality of analog scanning lines. The field constituting the one image may include the current setting period in which the analog current setting is performed and the digital driving period in which the digital driving is performed. The digital driving period may include the first to n-th scanning line selection periods in which the first to n-th bits of the display data are set to the pixel circuits and the first to n-th display periods in which the light emitting device is on or off in accordance with the first to n-th bits set to the pixel circuits. n is an integer equal to or greater than 2. The on period may be the display period in which the light emitting device is on, of the first to n-th display periods.

According to the embodiment, in the digital driving period, the light emitting element emits the light in the on period of the length corresponding to the grayscale value of the display data. Sine the light emission luminance averaged over time in the one frame is determined by a ratio of the on period occupying the one frame, the luminance is obtained by dividing up the maximum luminance by the grayscale value. By adjusting the drive current of the light emitting element in the current setting period, the maximum luminance of the light emitting element is determined, and thus the display luminance adjustment can be made without reducing the number of display gradations.

Further, in the embodiment, the digital driving circuit may turn off the light emitting element in the current setting period.

As described above, in the embodiment, when the given scanning line performs the analog current setting, the other scanning lines can perform the digital driving. In other words, although the light emitting element is off in the scanning line that performs the analog current setting, the display can be performed by the digital driving in the other scanning lines. In this way, there is no period in which the display is off over the entire screen, and it is thus possible to reduce the flickering of the display and the like.

Further, in the embodiment, the current setting period in the s-th pixel circuit electrically connected to the s-th analog scanning line may overlap with any one of the first to n-th scanning line selection periods in the t-th pixel circuit electrically connected to the t-th digital scanning line.

The scanning line selection period is the period in which the bits of display data are set to the digital driving circuit. According to the embodiment, the analog scanning line and the analog signal line are provided with respect to the analog driving circuit, and the digital scanning line and the digital signal line are provided with respect to the digital driving circuit. Thus, the scanning line selection period and the current setting period can be caused to overlap with each other.

Further, in the embodiment, the field may include the plurality of subfields. In the subfield included in the plurality of subfields, the scanning line drive circuit may select, the one time, the one scanning line group that is the selection target, from among the plurality of digital scanning lines. The scanning line group may include the digital scanning line electrically connected to the pixel circuit to which the i-th bit, of the first to n-th bits of display data, is written in the subfield, and the digital scanning line electrically connected to the pixel circuit to which the j-th bit, of the first to n-th bits of display data, is written in the subfield. i is an integer equal to or greater than 1 and equal to or less than n, and j is an integer equal to or greater than 1 and equal to or less than n, and is different from i.

According to the embodiment, the i-th bit is set to the one scanning line in the one subfield, and the j-th bit is set to another of the scanning lines. In this way, a non-scanning period in which the scanning line is not selected can be reduced, and the scanning line drive frequency can be decreased compared to the known method.

Further, in the embodiment, each of the subfields of the plurality of subfields may be a period of the same length.

Further, in the embodiment, in the subfield, the scanning line driving circuit may select, as the scanning line group, the n digital scanning lines from the digital line electrically connected to the pixel circuit where the first bit is to be set to the digital scanning line electrically connected to the pixel circuit where the n-th bit is to be written, and may also select the analog scanning line of the pixel circuit electrically connected to the digital scanning line different from the n digital scanning lines.

Each of the subfields being the period of the same length means that the number of scanning lines of the selected scanning line group is the same in each of the subfields. Then, the same number of scanning lines as the number of bits of the display data are selected while being shifted for each of the subfields until one cycle is completed. As a result, the first to n-th bits are written into all of the scanning lines in the one frame. Then, in each of the subfields, the analog current setting is performed on the scanning line different from the scanning line group, and thus the analog current setting is performed in all of the scanning lines in the one frame.

Further, in the embodiment, the length of the current setting period may be the length of one or a plurality of the subfields.

According to the embodiment, since the length of the current setting period can be freely set, the write time of the analog data voltage can be sufficiently secured in response to the increase in the number of pixels of the display panel, and the like. As described above, in the embodiment, when the given scanning line performs the analog current setting, the other scanning lines can perform the digital driving. Therefore, even when the current setting period is longer, the effect on the display is small, and the scanning line selection frequency of the digital driving is also substantially unchanged.

Further, in the embodiment, the length of the first display period may be a-times the length of the subfield. a is an integer equal to or greater than 1. The field may include the non-digital driving period. The non-digital driving period may have the length that is b-times the length of the subfield, may be the period other than the digital driving period, and may include the current setting period. b is an integer equal to or greater than 1. The number of scanning line selections in the one frame is denoted by Nfr, and the number of bits in the display data is denoted by n. n is an integer equal to or greater than 2. At this time, the following may be established: $Nfr=((2n-1)\times a+1)\times n+b\times n$.

According to the embodiment, in the range in which the number k of the scanning lines can be an integer, the number of bits n of the display data, the multiple a indicating the length of the display period of the first bit, and the variable b indicating the length of the non-digital driving period can be freely adjusted. In this way, the embodiment can be applied to the display panels having the varying numbers of pixels. Further, since the variable b is variable, the length of the current setting period can be freely adjusted, and even in a high definition display panel or the like, the write time of the analog data voltage can be sufficiently secured.

In the embodiment, the current setting period may include the first scanning line selection period. In the first scanning line selection period, the analog driving circuit may perform the analog current setting and, at the same time, the first bit of the display data may be set to the digital driving circuit.

According to the embodiment, the analog current setting and the digital driving can be independently controlled, and thus, the current setting period can be extended to the first scanning line selection period. From the first display period, in order to cause the light to be emitted at the drive current set by the analog current setting, it is appropriate to extend the current setting period up to the first scanning line selection period. By extending the current setting period, the write time of the analog data voltage can be extended.

Further, in the embodiment, the field may include the digital driving period, the current setting period, and the non-emitting period. The non-emitting period may be provided between the $\alpha$-th display period of the first to n-th display periods and the $\alpha+1$-th scanning line selection period of the first to n-th scanning line selection periods. $\alpha$ is an integer equal to or greater than 1 and equal to or less than $n-1$. The digital driving circuit may turn off the light emitting element during the non-emitting period.

When the light emitting element is consecutively on in the two adjacent display periods, the on state of the light emitting element continues for a long time in the frame. According to the embodiment, the non-emitting period is provided between the two adjacent display periods, and thus the time over which the light emitting element is continuously on can be shortened. In this way, the flickering of the video can be reduced.

Further, in the embodiment, the field may include the digital driving period, the current setting period, and the non-emitting period. The $\beta$-th display period of the first to n-th display periods may be divided into the first $\beta$-th display period and the second $\beta$-th display period. $\beta$ is an integer equal to or greater than 1 and equal to or less than n. The non-emitting period may be provided between the first $\beta$-th display period and the second $\beta$-th display periods. The digital driving circuit may turn off the light emitting element during the non-emitting period.

When the light emitting element continues to be turned on for a long period of time in the frame, there is a possibility that the light emitting element may flicker when a video appearing on the screen is viewed. According to the embodiment, the relatively long display period can be divided into the two display periods, and thus the flickering of the video can be reduced.

Further, in the embodiment, in the field, the first to n-th bits of the display data may be set to each of the pixel circuits by the scanning line driving circuit selecting each of the digital scanning lines, of the plurality of digital scanning lines, n times each.

When focusing on the one scanning line, the first to n-th scanning line selection periods and the first to n-th display periods are required in the one field. According to the embodiment, each of the scanning lines is selected n times, and the first to n-th bits are set to those scanning lines. In this way, in the one field, the first to n-th scanning line selection periods and the first to n-th display periods are realized for all of the scanning lines.

Further, in the embodiment, the analog driving circuit may include the capacitor that holds the analog data voltage, the switching circuit provided between the analog signal line and the one end of the capacitor, and the current supply transistor that supplies, to the digital driving circuit, the drive current corresponding to the analog data voltage held in the capacitor.

According to the embodiment, the analog data voltage is applied to the one end of the capacitor from the analog signal line via the switching circuit, and the analog data voltage is held in the capacitor. In this way, the analog driving circuit can provide the drive current to the digital driving circuit in accordance with the analog data voltage held in the capacitor.

Further, in the embodiment, the digital driving circuit may include the storage circuit that stores the display data, and the drive transistor that is turned on or off based on the output signal from the storage circuit and supplies the drive current to the light emitting device when turned on.

According to the embodiment, the display data from the digital signal line is stored in the storage circuit, and the drive transistor is turned on or off based on the output signal from the storage circuit. In this way, when the drive transistor is turned on, the digital driving circuit can supply the drive current set based on the analog data voltage to the light emitting device.

Further, in the embodiment, to the analog signal line, the analog data voltage may be input that is a voltage based on the luminance information of the environment and causes the current value of the drive current to be reduced as the luminance of the environment becomes lower.

In this way, the display luminance is adjusted based on the luminance information of the environment. In other words, the lower the luminance of the environment, the lower the drive current of the light emitting element, and thus the light emission luminance of the light emitting element decreases.

Further, in the embodiment, the electronic apparatus includes any one of the electro-optical devices described above.

Further, the electronic apparatus according to the embodiment may include any one of the electro-optical devices described above, and the sensor that measures the luminance information.

Although the embodiment has been described in detail above, those skilled in the art will easily understand that many modified examples can be made without substantially departing from novel items and effects of the present disclosure. All such modified examples are thus included in the scope of the disclosure. For example, terms in the descriptions or drawings given at least once along with different terms having identical or broader meanings can be replaced with those different terms in all parts of the descriptions or drawings. All combinations of the embodiment and the modified examples are also included within the scope of the present disclosure. Further, the configurations, operations, and the like of the circuit device, the pixel array, the display controller, the display system, the sensor, the electro-optical device, the electronic apparatus, and the like are not limited to those described in the embodiment, and various modifications thereof are possible.

What is claimed is:

1. An electro-optical device comprising:

a plurality of digital scanning lines;

a plurality of analog scanning lines;

a scanning line driving circuit configured to drive the plurality of digital scanning lines and the plurality of analog scanning lines;

a digital signal line;

an analog signal line; and a plurality of pixel circuits, wherein each pixel circuit of the plurality of pixel circuits includes a light emitting element, a digital driving circuit configured to perform digital driving in which display data is set through the digital signal line when the digital driving circuit is selected through one of the digital scanning lines of the plurality of digital scanning lines, and a drive current is supplied to the light emitting element in a period of a length corresponding to a grayscale value of the display data, an analog driving circuit configured to perform analog driving setting in which an analog data voltage is set through the analog signal line when the analog driving circuit is selected through one of the analog scanning lines of the plurality of analog scanning lines, and a current value of the drive current is variably set based on the analog data voltage, each pixel circuit is electrically connected to a digital scanning line included in the plurality of digital scanning lines, an analog scanning line included in the plurality of analog scanning lines, the digital signal line, and the analog signal line, in a period in which an s-th pixel circuit performs an analog current setting, a t-th pixel circuit performs the digital driving, the s-th pixel circuit being, of the plurality of pixel circuits, a pixel circuit electrically connected to an s-th digital scanning line and an s-th analog scanning line, s being an integer of 1 or more, and the t-th pixel circuit being, of the plurality of pixel circuits, a pixel circuit electrically connected to a t-th digital scanning line and a t-th analog scanning line, t being an integer of 1 or more and different from s, a field constituting one image includes a current setting period in which the analog current setting is performed and a digital driving period in which the digital driving is performed, the digital driving period includes first to n-th scanning line selection periods in which first to n-th bits of the display data are set to the pixel circuit, n being an integer of 2 or more, and first to n-th display periods in which the light emitting element is on or off in accordance with the first to n-th bits set to the pixel circuit, and the on period is a display period, in which the light emitting element is on, of the first to n-th display periods.

2. The electro-optical device according to claim 1, wherein the digital driving circuit keeps the light emitting element off in the current setting period.

3. The electro-optical device according to claim 1, wherein the current setting period of the s-th pixel circuit electrically connected to the s-th analog scanning line overlaps with any one of the first to n-th scanning line selection periods of the t-th pixel circuit electrically connected to the t-th digital scanning line.

4. The electro-optical device according to claim 1, wherein the field includes a plurality of subfields, in a subfield included in the plurality of subfields, the scanning line driving circuit selects, one time, a scanning line group as a selection target, among the plurality of digital scanning lines, and the scanning line group includes a digital scanning line electrically connected to a pixel circuit to which an i-th bit is to be written, of the first to n-th bits of the display data in the subfield i being an integer from 1 to n, and a digital scanning line electrically connected to a pixel circuit to which a j-th bit is to be written, of the first to n-th bits of the display data in the subfield j being an integer of 1 or more and different from i.

5. The electro-optical device according to claim 4, wherein each subfield of the plurality of subfields is a period of the same length.

6. The electro-optical device according to claim 4, wherein in the subfield, the scanning line driving circuit selects, as the scanning line group, n digital scanning lines from a digital line electrically connected to a pixel circuit to which the first bit is to be set to a digital scanning line electrically connected to a pixel circuit to which the n-th bit is to be written, and also, selects an analog scanning line of a pixel circuit electrically connected to a digital scanning line different from the n digital scanning lines.

7. The electro-optical device according to claim 4, wherein a length of the current setting period is a length of one or a plurality of the subfields.

8. The electro-optical device according to claim 4, wherein a length of the first display period is a-times a length of the subfield, a being an integer of 1 or more, the field includes a non-digital driving period, the non-digital driving period having a length b-times the length of the subfield, b being an integer of 1 or more, being a period other than the digital driving period, and including the current setting period, and $$Nfr=((2n-1)\times a+1)\times n+b\times n$$

where a number of scanning line selections in the field is Nfr, and a number of bits of the display data is n, n being an integer of 2 or more.

9. The electro-optical device according to claim 4, wherein the current setting period includes the first scanning line selection period, and in the first scanning line selection period, the first bit of the display data is set to the digital driving circuit at the same time that the analog driving circuit performs the analog current setting.

10. The electro-optical device according to claim 4, wherein the field includes the digital driving period, the current setting period, and a non-emitting period, the non-emitting period is provided between an $\alpha$-th display period of the first to n-th display periods and an $\alpha+1$-th scanning line selection period of the first to n-th scanning line selection periods, $\alpha$ being an integer from 1 to n−1, and the digital driving circuit keeps the light emitting element off in the non-emitting period.

11. The electro-optical device according to claim 4, wherein the field includes the digital driving period, the current setting period, and a non-emitting period, a $\beta$-th display period of the first to n-th display periods is divided into a first $\beta$-th display period and a second $\beta$-th display period, $\beta$ being an integer from 1 to n, the non-emitting period is provided between the first $\beta$-th display period and the second $\beta$-th display period, and the digital driving circuit keeps the light emitting element off in the non-emitting period.

12. The electro-optical device according to claim 4, wherein the first to n-th bits of the display data are set to each pixel circuit by the scanning line driving circuit selecting each scanning line, of the plurality of digital scanning lines, n times each in the field.

13. The electro-optical device according to claim 1, wherein the digital driving circuit includes a storage circuit configured to store the display data, and a drive transistor configured to be on or off based on an output signal from the storage circuit, and to supply the drive current to the light emitting element when the drive transistor is on.

14. An electronic apparatus comprising:

the electro-optical device according to claim 1.

15. An electro-optical device comprising:

a plurality of digital scanning lines;

a plurality of analog scanning lines;

a digital signal line;

an analog signal line; and a plurality of pixel circuits, wherein each pixel circuit of the plurality of pixel circuits includes a light emitting element, a digital driving circuit configured to perform digital driving in which display data is set through the digital signal line when the digital driving circuit is selected through one of the digital scanning lines of the plurality of digital scanning lines, and a drive current is supplied to the light emitting element in a period of a length corresponding to a grayscale value of the display data, an analog driving circuit configured to perform analog driving setting in which an analog data voltage is set through the analog signal line when the analog driving circuit is selected through one of the analog scanning lines of the plurality of analog scanning lines, and a current value of the drive current is variably set based on the analog data voltage, each pixel circuit is electrically connected to a digital scanning line included in the plurality of digital scanning lines, an analog scanning line included in the plurality of analog scanning lines, the digital signal line, and the analog signal line, in a period in which an s-th pixel circuit performs an analog current setting, a t-th pixel circuit performs the digital driving, the s-th pixel circuit being, of the plurality of pixel circuits, a pixel circuit electrically connected to an s-th digital scanning line and an s-th analog scanning line, s being an integer of 1 or more, and the t-th pixel circuit being, of the plurality of pixel circuits, a pixel circuit electrically connected to a t-th digital scanning line and a t-th analog scanning line, t being an integer of 1 or more and different from s, and the analog driving circuit includes a capacitor configured to hold the analog data voltage, a switching circuit provided between the analog signal line and one end of the capacitor, and a current supply transistor configured to supply, to the digital driving circuit, the drive current corresponding to the analog data voltage held in the capacitor.

16. The electro-optical device according to claim 15, wherein the digital driving circuit includes a storage circuit configured to store the display data, and a drive transistor configured to be on or off based on an output signal from the storage circuit, and to supply the drive current to the light emitting element when the drive transistor is on.

17. An electronic apparatus comprising:

the electro-optical device according to claim 15.

18. An electro-optical device comprising:

a plurality of digital scanning lines;

a plurality of analog scanning lines;

a digital signal line;

an analog signal line; and a plurality of pixel circuits, wherein each pixel circuit of the plurality of pixel circuits includes a light emitting element, a digital driving circuit configured to perform digital driving in which display data is set through the digital signal line when the digital driving circuit is selected through one of the digital scanning lines of the plurality of digital scanning lines, and a drive current is supplied to the light emitting element in a period of a length corresponding to a grayscale value of the display data, an analog driving circuit configured to perform analog driving setting in which an analog data voltage is set through the analog signal line when the analog driving circuit is selected through one of the analog scanning lines of the plurality of analog scanning lines, and a current value of the drive current is variably set based on the analog data voltage, each pixel circuit is electrically connected to a digital scanning line included in the plurality of digital scanning lines, an analog scanning line included in the plurality of analog scanning lines, the digital signal line, and the analog signal line, in a period in which an s-th pixel circuit performs an analog current setting, a t-th pixel circuit performs the digital driving, the s-th pixel circuit being, of the plurality of pixel circuits, a pixel circuit electrically connected to an s-th digital scanning line and an s-th analog scanning line, s being an integer of 1 or more, and the t-th pixel circuit being, of the plurality of pixel circuits, a pixel circuit electrically connected to a t-th digital scanning line and a t-th analog scanning line, t being an integer of 1 or more and different from s, and to the analog signal line, the analog data voltage is input that is a voltage based on the luminance information of environment and causes the current value of the drive current to be smaller as the luminance of the environment becomes lower.

19. An electronic device comprising:

the electro-optical device according to claim 18; and a sensor configured to measure the luminance information.

20. An electronic apparatus comprising:

the electro-optical device according to claim 18.

* * * * *